US007738000B2

(12) United States Patent
Furukawa et al.

(10) Patent No.: US 7,738,000 B2
(45) Date of Patent: Jun. 15, 2010

(54) DRIVING SYSTEM FOR DISPLAY DEVICE

(75) Inventors: Tomoo Furukawa, Matsusaka (JP); Makoto Shiomi, Tenri (JP); Tai Shiraishi, Yamatokoriyama (JP); Mitsuhiro Shigeta, Kameyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 1512 days.

(21) Appl. No.: 11/065,246

(22) Filed: Feb. 25, 2005

(65) Prior Publication Data

US 2005/0190610 A1 Sep. 1, 2005

(30) Foreign Application Priority Data

Feb. 26, 2004 (JP) ..... 2004-052301

(51) Int. Cl.
*G09G 5/02* (2006.01)

(52) U.S. Cl. ..... 345/690; 365/189.05

(58) Field of Classification Search ..... 345/89, 345/600, 690, 596; 365/189.05; 349/41; 348/671

See application file for complete search history.

(56) References Cited

U.S. PATENT DOCUMENTS

| | | | | |
|---|---|---|---|---|
| 6,982,722 | B1 * | 1/2006 | Alben et al. | 345/596 |
| 2001/0026283 | A1 * | 10/2001 | Yoshida et al. | 345/600 |
| 2003/0133045 | A1 * | 7/2003 | Funke et al. | 348/671 |
| 2004/0125064 | A1 * | 7/2004 | Adachi et al. | 345/89 |
| 2005/0099549 | A1 * | 5/2005 | Chen et al. | 349/41 |

FOREIGN PATENT DOCUMENTS

| | | | |
|---|---|---|---|
| JP | 2650479 | B | 5/1997 |
| JP | 2708746 | B | 10/1997 |
| JP | 2001-337667 | A | 12/2000 |
| JP | 2002-116743 | A | 4/2002 |

* cited by examiner

*Primary Examiner*—Amare Memgistu
*Assistant Examiner*—Yuk Chow
(74) *Attorney, Agent, or Firm*—Harness, Dickey & Pierce, P.L.C.

(57) ABSTRACT

A driving system of the present invention for use in a displaying device is provided with a pseudo bit-depth extension section. In the pseudo bit-depth extension section, a noise pattern is added to upper-n-bit data of an input signal D0 in m-bit, where (i) m is an integer of 9 or greater, and (ii) n is an integer of 8 or greater, but less than m. Then, upper-n-bit of data D1 thus obtained from the D0 is outputted, as output data D2, from the pseudo bit-depth extension section. The driving system is further provided with an overshoot-driving section for carrying out an overshoot-driving with respect to each of pixels. A noise amount of the noise pattern is 1 or less in 8-bit data, and a calculation in the overshoot-driving section is carried out with n-bit data. With this driving system which adopts a combination of (a) a overshoot-driving method for enforcing liquid crystal to respond at a high speed, and (b) a bit-depth extension technology in which a number of grayscales is increased by adding noise, it is possible to provide, at a low cost, a high-definition displaying device such as a liquid crystal display, having a high-response-characteristics and a high quality of grayscale reproduction.

36 Claims, 23 Drawing Sheets

FIG. 14 (a)

8-BITS

| | | | | | | | |
|---|---|---|---|---|---|---|---|
| 60 | 60 | 60 | 60 | 60 | 60 | 60 | 60 |
| 60 | 60 | 60 | 60 | 60 | 60 | 60 | 60 |
| 60 | 60 | 60 | 60 | 60 | 60 | 59 | 59 |
| 60 | 60 | 60 | 60 | 60 | 60 | 59 | 59 |
| 60 | 60 | 60 | 60 | 59 | 59 | 59 | 59 |
| 60 | 60 | 60 | 60 | 59 | 59 | 59 | 59 |
| 60 | 60 | 59 | 59 | 59 | 59 | 59 | 59 |
| 60 | 60 | 59 | 59 | 59 | 59 | 59 | 59 |

FIG. 14 (b)

10-BITS (GRAYSCALE VALUES ARE INDICATED IN 8-BITS)

| | | | | | | | |
|---|---|---|---|---|---|---|---|
| 60.75 | 60.75 | 60.5 | 60.5 | 60.25 | 60.25 | 60 | 60 |
| 60.75 | 60.75 | 60.5 | 60.5 | 60.25 | 60.25 | 60 | 60 |
| 60.5 | 60.5 | 60.25 | 60.25 | 60 | 60 | 59.75 | 59.75 |
| 60.5 | 60.5 | 60.25 | 60.25 | 60 | 60 | 59.75 | 59.75 |
| 60.25 | 60.25 | 60 | 60 | 59.75 | 59.75 | 59.5 | 59.5 |
| 60.25 | 60.25 | 60 | 60 | 59.75 | 59.75 | 59.5 | 59.5 |
| 60 | 60 | 59.75 | 59.75 | 59.5 | 59.5 | 59.25 | 59.25 |
| 60 | 60 | 59.75 | 59.75 | 59.5 | 59.5 | 59.25 | 59.25 |

FIG. 15 (a)

SCROLLING DIRECTION

BEFORE SCROLLING

| | | | | | | | |
|---|---|---|---|---|---|---|---|
| 60.75 | 60.75 | 60.5 | 60.5 | 60.25 | 60.25 | 60 | 60 |
| 60.75 | 60.75 | 60.5 | 60.5 | 60.25 | 60.25 | 60 | 60 |
| 60.5 | 60.5 | 60.25 | 60.25 | 60 | 60 | 59.75 | 59.75 |
| 60.5 | 60.5 | 60.25 | 60.25 | 60 | 60 | 59.75 | 59.75 |
| 60.25 | 60.25 | 60 | 60 | 59.75 | 59.75 | 59.5 | 59.5 |
| 60.25 | 60.25 | 60 | 60 | 59.75 | 59.75 | 59.5 | 59.5 |
| 60 | 60 | 59.75 | 59.75 | 59.5 | 59.5 | 59.25 | 59.25 |
| 60 | 60 | 59.75 | 59.75 | 59.5 | 59.5 | 59.25 | 59.25 |

FIG. 15 (b)

AFTER SCROLLING

| | | | | | | | |
|---|---|---|---|---|---|---|---|
| 60.25 | 60.25 | 60 | 60 | 59.75 | 59.75 | 59.5 | 59.5 |
| 60.25 | 60.25 | 60 | 60 | 59.75 | 59.75 | 59.5 | 59.5 |
| 60 | 60 | 59.75 | 59.75 | 59.5 | 59.5 | 59.25 | 59.25 |
| 60 | 60 | 59.75 | 59.75 | 59.5 | 59.5 | 59.25 | 59.25 |
| 59.75 | 59.75 | 59.5 | 59.5 | 59.25 | 59.25 | 59 | 59 |
| 59.75 | 59.75 | 59.5 | 59.5 | 59.25 | 59.25 | 59 | 59 |
| 59.5 | 59.5 | 59.25 | 59.25 | 59 | 59 | 58.75 | 58.75 |
| 59.5 | 59.5 | 59.25 | 59.25 | 59 | 59 | 58.75 | 58.75 |

FIG. 16 (a)

SCROLLING DIRECTION

BEFORE SCROLLING

ORIGINAL DATA (8-BITS)

| | | | | | | | |
|---|---|---|---|---|---|---|---|
| 60 | 60 | 60 | 60 | 60 | 60 | 60 | 60 |
| 60 | 60 | 60 | 60 | 60 | 60 | 60 | 60 |
| 60 | 60 | 60 | 60 | 60 | 60 | 59 | 59 |
| 60 | 60 | 60 | 60 | 60 | 60 | 59 | 59 |
| 60 | 60 | 60 | 60 | 59 | 59 | 59 | 59 |
| 60 | 60 | 60 | 60 | 59 | 59 | 59 | 59 |
| 60 | 60 | 59 | 59 | 59 | 59 | 59 | 59 |
| 60 | 60 | 59 | 59 | 59 | 59 | 59 | 59 |

+

NOISE PATTERN

| | | | | | | | |
|---|---|---|---|---|---|---|---|
| 1 | 1 | 0 | 1 | 0 | 0 | 0 | 0 |
| 1 | 0 | 1 | 0 | 1 | 0 | 0 | 0 |
| 0 | 1 | 0 | 0 | 0 | 0 | 1 | 0 |
| 1 | 0 | 1 | 0 | 0 | 0 | 1 | 1 |
| 0 | 0 | 0 | 0 | 1 | 1 | 0 | 1 |
| 1 | 0 | 0 | 0 | 1 | 0 | 1 | 0 |
| 0 | 0 | 1 | 0 | 0 | 1 | 0 | 1 |
| 0 | 0 | 1 | 1 | 1 | 0 | 0 | 0 |

||

ACTUALLY OUTPUTTED GRAYSCALES

| | | | | | | | |
|---|---|---|---|---|---|---|---|
| 61 | 61 | 60 | 61 | 60 | 60 | 60 | 60 |
| 61 | 60 | 60 | 60 | 61 | 60 | 60 | 60 |
| 60 | 61 | 60 | 60 | 60 | 60 | 60 | 59 |
| 61 | 60 | 61 | 60 | 60 | 60 | 60 | 60 |
| 60 | 60 | 60 | 60 | 60 | 60 | 59 | 60 |
| 61 | 60 | 60 | 60 | 60 | 59 | 60 | 59 |
| 60 | 60 | 60 | 59 | 59 | 60 | 59 | 60 |
| 60 | 60 | 60 | 60 | 60 | 59 | 59 | 59 |

FIG. 16 (b)

AFTER SCROLLING

ORIGINAL DATA (8-BITS)

| | | | | | | | |
|---|---|---|---|---|---|---|---|
| 60 | 60 | 60 | 60 | 59 | 59 | 59 | 59 |
| 60 | 60 | 60 | 60 | 59 | 59 | 59 | 59 |
| 60 | 60 | 59 | 59 | 59 | 59 | 59 | 59 |
| 60 | 60 | 59 | 59 | 59 | 59 | 59 | 59 |
| 59 | 59 | 59 | 59 | 59 | 59 | 59 | 59 |
| 59 | 59 | 59 | 59 | 59 | 59 | 59 | 59 |
| 59 | 59 | 59 | 59 | 59 | 59 | 58 | 58 |
| 59 | 59 | 59 | 59 | 59 | 59 | 58 | 58 |

+

NOISE PATTERN

| | | | | | | | |
|---|---|---|---|---|---|---|---|
| 0 | 0 | 0 | 0 | 1 | 1 | 1 | 0 |
| 0 | 1 | 0 | 0 | 0 | 1 | 0 | 1 |
| 0 | 0 | 1 | 1 | 1 | 0 | 1 | 0 |
| 0 | 0 | 0 | 1 | 1 | 0 | 0 | 0 |
| 1 | 1 | 1 | 1 | 0 | 0 | 0 | 0 |
| 0 | 1 | 0 | 0 | 1 | 0 | 0 | 0 |
| 1 | 0 | 0 | 0 | 0 | 0 | 1 | 1 |
| 0 | 1 | 0 | 1 | 0 | 0 | 1 | 0 |

||

ACTUALLY OUTPUTTED GRAYSCALES

| | | | | | | | |
|---|---|---|---|---|---|---|---|
| 60 | 60 | 60 | 60 | 60 | 60 | 60 | 59 |
| 60 | 61 | 60 | 60 | 59 | 60 | 59 | 60 |
| 60 | 60 | 60 | 60 | 60 | 59 | 60 | 59 |
| 60 | 60 | 59 | 60 | 60 | 59 | 59 | 59 |
| 60 | 60 | 60 | 60 | 59 | 59 | 59 | 59 |
| 59 | 60 | 59 | 59 | 60 | 59 | 59 | 59 |
| 60 | 59 | 59 | 59 | 59 | 59 | 59 | 59 |
| 59 | 60 | 59 | 60 | 59 | 59 | 59 | 58 |

DRIVING SYSTEM FOR DISPLAY DEVICE

This Nonprovisional application claims priority under 35 U.S.C. §119(a) on Patent Application No. 2004/52301 filed in Japan on Feb. 26, 2004, the entire contents of which are hereby incorporated by reference.

FIELD OF THE INVENTION

The present invention relates to a driving system for use in a display device, such as a liquid crystal display device carrying out image display with a liquid crystal display panel, and relates particularly to a driving system which improves display quality of the display device.

BACKGROUND OF THE INVENTION

A flat panel display (FPD) serving as a display device has been remarkably advancing in recent years, and various forms of the FPD are superseding the CRT (Cathode Ray Tube) monitors. While the CRT monitor requires a large depthwise dimension, and occupies a large space for setting it up, the FPD can be built thin with significantly reduced depthwise dimension. This allows the FPD to be set up in a space smaller than the space needed for the CRT monitor. Among the various forms of the FPD, a liquid crystal display device (Hereinafter referred to as LCD), in particular, is a forerunning form of the FPD, and remarkable advancement in LCD technology has caused diverse uses of the LCD in various scenes of everyday life, thus attracting more attention to a further advancement of the LCD technology.

However, there still remain some unigonorable weaknesses in the LCD yet to be overcome: for example, a response speed and a quality of image reproduction. In order to improve these weaknesses, two technologies are introduced to the LCD.

One of the technologies is called overshoot-driving in which the response speed of liquid crystal (Hereinafter referred to as LC) is compulsively accelerated by applying a greater potential difference to the LC than the general potential difference required for switching LC. Patent document 1 discloses a liquid crystal drive circuit adopting such a overshoot-driving.

Another one of the technologies is called pseudo bit-depth extension, such as dithering, in which a noise pattern is added to increase the level of grayscales. For example, in a case where an LCD adopts an n-bit driver that can handle n-bit data, the noise pattern is added to n-bit grayscales data ($2^n$ grayscales (n is an integer)), so that an improved vision seemingly having grayscales of m-bit data ($2^m$ grayscales (m is an integer and m>n) is obtained from the n-bit data.

The cost of a LCD driver increases as it handles a larger number of bits. In this view, the pseudo bit-depth extension is an effective solution to realize a LCD capable of displaying a larger number of visible grayscales, thus achieving a high quality of the image reproduction, without a cost increase of the driver. Patent document 2 discloses an example of image display device and image processing device thereof, adopting the pseudo bit-depth extension technology.

Thus, with a combination of the overshoot-driving technology and the pseudo bit-depth extension technology, it is possible to realize an LCD with a high response speed and a high quality of the image reproduction.

As described above, the overshoot-driving boosts signals, and the pseudo bit-depth extension technology adds a noise. Here, when these technologies are combined in order to realize an LCD with a high-response speed and a high quality of the image reproduction, the two technologies must be appropriately combined. In an LCD in which those technologies are inadequately combined, the overshoot-driving may boost noise as well, causing the LCD to output noise-rich images.

(Patent Document 1)

Japanese Patent No. 2708746 (registered on Oct. 17, 1997)

(Patent Document 2)

Japanese Unexamined Patent Publication No. 2001-337667 (Tokukai 2001-337667; published on Dec. 7, 2001)

In view of the foregoing problem, in a conventional display device, the pseudo bit-depth extension has been carried out after the overshoot-driving is performed. This, however, requires a larger scale of circuit; therefore an increase in the costs for the circuit becomes an inevitable problem.

Firstly, the following provides a little more specific explanation about the pseudo bit-depth extension. In the pseudo bit-depth extension, a signal representing m-bit data (where m>n) is inputted to the LCD from which n-bit data is outputted. A periodical noise pattern is added, by using a circuit, to the upper-n-bit data of the inputted m-bit data, and n-bit data is outputted. This noise pattern, when averaging a certain cycles of it, is generated so as to cause data to become data in m-bit.

In short, by adding the noise pattern to the n-bit data, the n-bit data to which the noise pattern is added indicates pseudo-m-bit grayscales. Thus, in the pseudo bit-depth extension, the m-bit data is inputted, and the n-bit data is outputted. If the overshoot-driving is carried out in a preceding stage of the pseudo bit-depth extension, the overshoot-driving has to be carried out with respect to the m-bit data.

Next, the following is a little more specific explanation on the operation of overshoot-driving. In the overshoot-driving, grayscale data of a first frame is compared with grayscale data of a (1-1) frame. Based on a difference in the respective grayscale data, an amount of data amplification is determined. Here, the (1-1) frame data is data of a preceding frame created by buffering the input data into a frame memory.

Accordingly, in the overshoot driving, an increase in bit-depth of data requires a larger volume of memory. As a result, the circuit scale needs to be enlarged, thereby increasing the cost. When the overshoot-driving is performed with respect to n-bit data, it simply requires an overshoot-driving circuit with a frame memory enough for storing the n-bit data. However, in the foregoing arrangement, a pseudo bit-depth extension block is arranged in a following stage of the overshoot-driving circuit; therefore, it is required to handle m-bit data in the overshoot driving.

As a result, the frame memory in the overshoot-driving block is enlarged to handle the m-bit data, thus causing the above-mentioned problem of cost rise. Further, in the overshoot-driving, an overshooting parameter for determining the amount of the data amplification is also stored in the form of m-bit. Therefore, the volume of memory for storing the overshooting parameter also increases, thus causing the foregoing problem of cost rise.

SUMMARY OF THE INVENTION

The present invention is made in view of the foregoing problems, and an object of the present invention is to provide a driving method and a driving system therefor which realize a display device such as an liquid crystal display device with a high-response characteristics and high quality image reproduction, without (i) distorting displayed image, (ii) enlarging a scale of circuit, and (iii) increasing in the cost.

In order to achieve the foregoing object, a driving system (driving circuit) of the present invention, which is capable of gradation display, the driving system for use in a display device includes: (I) a pseudo bit-depth extension block for increasing visible gradation levels by (i) adding a noise pattern to upper-8-bits of input m-bit data (m being an integer not less than 9), and (ii) outputting as output data upper-n-bit (n being an integer not less than 8 and less than m) of data obtained by adding the noise pattern to the upper-8 bits of the input m-bit data; (II) an overshoot-driving block for performing overshoot-driving in display operation, an amount of the noise pattern being not more than 1 in 8-bit data, and the overshoot-driving block for performing calculation on 8-bit basis. "The noise not greater than 1 in 8 bits data" refers to varying gradation level by a noise in an amount of 1 or less.

The foregoing arrangement (I) adopts a displaying device that outputs n-bit data where n is not less than 8, (II) minimizes a noise amount (1 or less) added to data in pseudo bit-depth extension, and (III) carries out overshoot-driving process consistently with 8-bit data. With this arrangement, for both algorisms :(a) the pseudo bit-depth extension is performed before the overshoot-driving, or (b) the overshoot-driving is performed before the pseudo bit-extension; the same effect can be obtained with the same scale of circuit.

Thus, the foregoing arrangement realizes high-quality image reproduction that is achieved by the overshoot-driving and the high-speed response obtained by the pseudo bit-depth extension. At the same time, the arrangement further achieves reduction in bit-number of data for use in the overshoot-driving. Thus the arrangement prevents an increase in the cost by an increase in memory amount and a number of calculation processes, due to an increase in bit-number of data.

Additional objects, features, and strengths of the present invention will be made clear by the description below. Further, the advantages of the present invention will be evident from the following explanation in reference to the drawings.

BRIEF DESCRIPTION OF THE DRAWINGS

FIG. 14(*a*) is a table of an oblique gradation for 8-bit data, and FIG. 14(*b*) is a table of an oblique gradation for 10-bit data obtained through a pseudo bit-depth extension with respect to the 8-bit oblique gradation shown in FIG. 14(*a*). The all values of this 10-bit oblique gradation are expressed based on 8-bits.

FIGS. 15(*a*) and 15(*b*) respectively show before and after the scrolling in the upper left direction of the oblique gradation with the pseudo bit-depth extension, as shown in FIG. 14(*b*).

FIG. 16(*a*) shows tables respectively showing an original gradation, a noise pattern added to the original gradation, and the resulting gradation by addition of the noise pattern. FIG. 16(*b*) shows the tables shown in FIG. 16(*a*) after the gradation is scrolled as in the case with FIG. 15, and also shows an error caused by the scrolling of the gradation.

FIG. 17(*a*) is an original gradation, FIG. 17(*b*) is a gradation according to a first comparative example, FIG. 17(*c*) is a gradation according to Embodiment 1 of the present invention, and FIG. 17(*d*) is a gradation according to Embodiment 2 of the present invention.

DESCRIPTION OF THE EMBODIMENTS

The following describes embodiments of the present invention with reference to FIG. 1 through FIG. 23. However, the present invention is not limited to the following embodiments. Further, each of the following embodiments deals with a case where n-bit data, which is outputted from a LCD (display device), is 8-bit data, and m-bit data supplied to the LCD is 10-bit data.

The LCD includes (i) a display section (displaying means: not shown) for displaying a full-color image according to a video signal, and (ii) an image processing device for processing the video signal according to display characteristics of the display section. The display section includes a LCD panel capable of color gradation display which includes pixels, and corresponding color filters arranged in a matrix-manner, and a source driver and a gate driver as driving means for driving the LCD panel.

The video signal which has been processed by the image processing device is supplied to the source driver. Then, according to the input video signal, the source driver applies a voltage to a source electrode line (not shown) of the LCD panel.

In the meantime, the gate driver is supplied with a sync signals (i.e. horizontal sync signal H and vertical sync signal V), and applies a voltage corresponding to the input sync signal to a gate electrode line (not shown) of the LCD panel.

In order to subject the output video signal to pseudo bit-depth extension, the image processing device adopts an area-modulation method such as dither method, as a grayscale reproduction method for full-color display. Note that, the grayscale reproduction method may be other methods than the area-modulation method, such as an amplitude modulation method, or a frame rate control method.

Further, the image processing device performs overshoot driving with respect to the video signal in order to accelerate response speed of the display section. The overshoot driving is a method of instantaneously applying a voltage higher than a standard voltage while the optical response in the display section is occurring, so that the optical response is accelerated.

Embodiment 1

Figure 1:
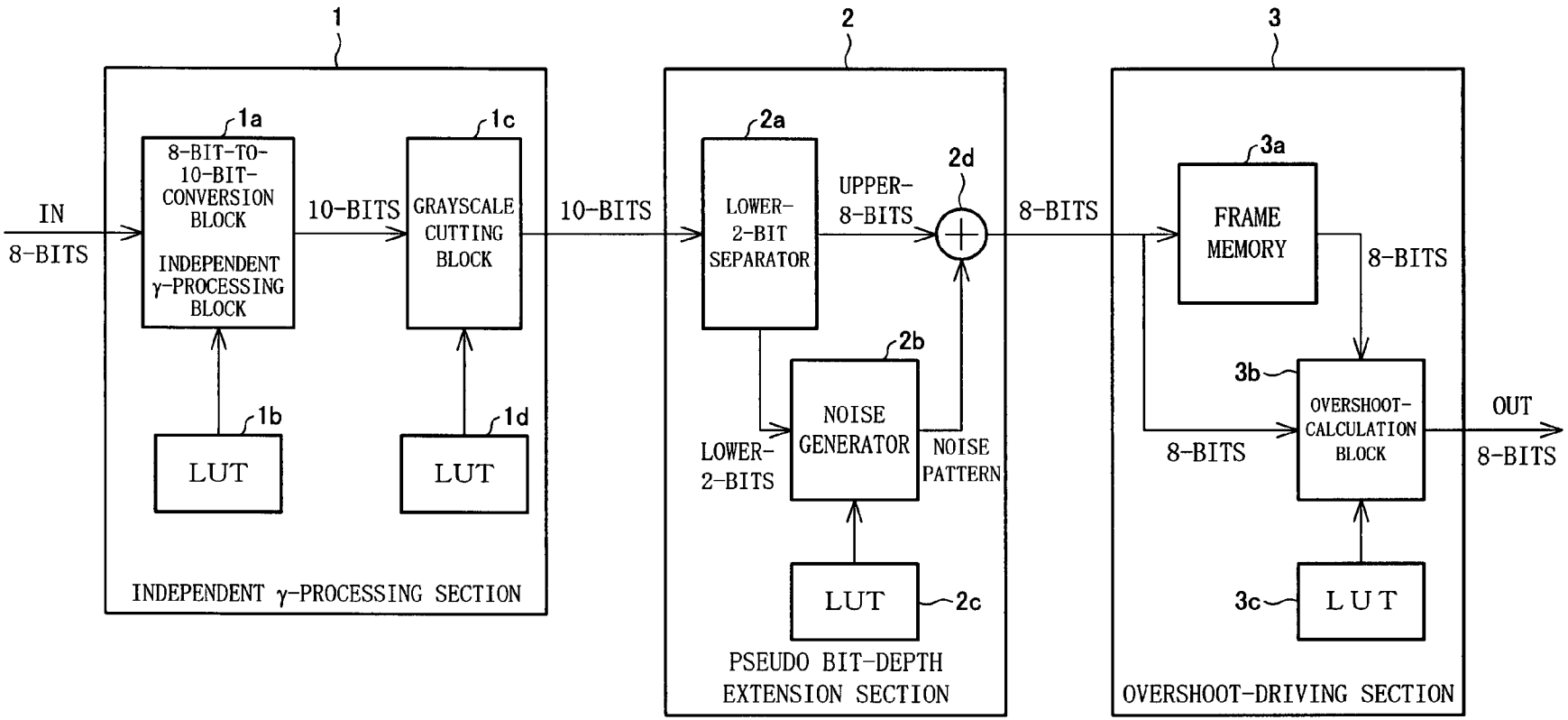
FIG. 1 is a circuit block diagram showing Embodiment 1 of a driving system in accordance with the present invention.

FIG. 1 is a schematic diagram illustrating a driving system according to Embodiment 1 of the present invention. The driving system is provided in the foregoing image processing device. The driving system has two circuit blocks, a pseudo bit-depth extension section (pseudo bit-depth extension block) 2 and an overshoot-driving section (overshoot-driving block) 3.

The pseudo bit-depth extension section 2 is provided with a lower-2-bit separator 2*a* for dividing 10-bit data into upper-8-bit data and the remaining bits, i.e., lower-2-bit data. Further, the pseudo bit-depth extension section 2 is provided with a noise generator 2*b* for generating a noise pattern with a noise amount=1 or less based on the lower-2-bit data. The noise with a noise amount of not greater than 1 refers to a small amount of noise causing a change of 1 grayscale level or less among 256 levels of grayscale of 8-bit data.

The pseudo bit-depth extension section 2 also includes a Look Up Table (Hereinafter referred to as LUT) 2*c*. The LUT 2*c* is a memory for storing in advance different noise patterns respectively corresponding to various types of 2-bit-data, as well as conversion rules for the noise patterns. The pseudo bit-depth extension section 2 further includes an adder 2*d* for adding the noise pattern to the upper 8-bit data.

The 10-bit data is supplied to the pseudo bit-depth extension section 2, and the lower-2-bit-data separator 2*a* converts the input 10-bit data into 8-bit data before the data is outputted. Here, the optimum noise pattern is created in the noise generator 2*b* with reference to the LUT 2*c*, based on (i) information of the lower-2 bits of the input 10-bit-data, (ii) a local coordinate of the data when the display area is divided into specific sized minute regions, and (iii) a value of a frame counter (not shown) in the circuit. The noise pattern is then outputted to the adder 2*d*. In the adder 2*d*, the noise pattern in an amount of 1 or less is added to the least-significant-bit of the upper-8-bit data outputted from the lower-2-bit separator 2*a*. A size of the minute region is preferably, for example, 8 pixels×8 pixels×RGB. The frame counter is reset every 8 frames, for example.

The 8-bit data from the pseudo bit-depth extension section 2 is inputted to the overshoot-driving section 3. The overshoot-driving section 3 carries out a calculation using the entire 8-bit data. An overshooting parameter of the overshoot-driving section 3 is 8-bit data, which is stored in an LUT 3*c* in the overshoot-driving section 3.

The driving system preferably further includes an independent γ-processing section 1, having a function of converting input 8-bit data into the 10-bit data before the data is supplied to the following pseudo bit-depth extension section 2 and the overshoot-driving section 3. The independent γ-processing section 1 includes (i) an independent γ-processing block 1*a* for converting 8-bit input grayscales into 10-bit data, and (ii) a grayscale cutting block 1*c* for cutting off some of the grayscale levels of the converted input signal, or for compressing the converted input signal to a signal including a region not containing the grayscales.

The Orders in layout (orders in processing) of the independent γ-block 1*a* and the grayscale cutting block 1*c* may be swapped according to the demands for the circuits. Idealistically, the independent γ-block 1*a* and the grayscale cutting block 1*c* carry out their conversion operations with calculations. However, to allow individual adjustment for each model, conversion rules of the independent γ-block 1*a* and the grayscale cutting block 1*c* are preferably stored in LUTs 1*b* and 1*d* separately. Further, the independent γ-processing section 1 preferably includes the independent γ-blocks for each of R, G, and B for color display, allowing separate processing for the respective colors.

As described, in a signal processing of the first embodiment, for example, a signal representing the inputted 8-bit data is first inputted to the independent γ-processing block 1*a*. The 8-bit data is then extended to the 10-bit data whose grayscale ranges from a 1st grayscale to a 1024th grayscale. Then, the 10-bit data is compressed to a signal whose grayscale ranges from a 32nd grayscale to a 992nd grayscale in the grayscale cutting block 1*c* before outputted. As described, the 10-bit data obtained after the γ-processing and the compression is outputted from the independent γ-processing section 1 as a 10-bit data signal. This 10-bit data signal is then sent to the pseudo bit-depth extension section 2.

In the pseudo bit-depth extension section 2, the input 10-bit data signal inputted is converted into an 8-bit data signal whose grayscale ranges from an 8th to a 248th grayscales. This 8-bit data signal is outputted, with the optimum noise pattern added thereto, from the pseudo bit-depth extension section 2, as 8-bit-data representing 10-bit information. The noise pattern is generated by the noise generator 2*b*, based on the conversion rules previously stored in the LUT 2*c*, with a noise amount not more than 1.

This 8-bit data is supplied to the overshoot-driving section 3. In the overshoot-driving section 3, the entire 8-bit data is stored in a frame memory 3*a*, and is also supplied to an overshoot-calculation block 3*b*. The overshoot-calculation block 3*b* executes an overshoot-calculation based on (a) the input 8-bit data, (b) 8-bit data of a previous frame, and (c) the overshooting-parameter read out from the LUT 3*c*, and outputs the resulting data.

This data resulted from the overshoot-calculation, having also been through the pseudo bit-depth extension, is applied to the LCD, so that the data is displayed as a high-quality image with high-speed response and a large number of grayscales.

Embodiment 2

Figure 2:
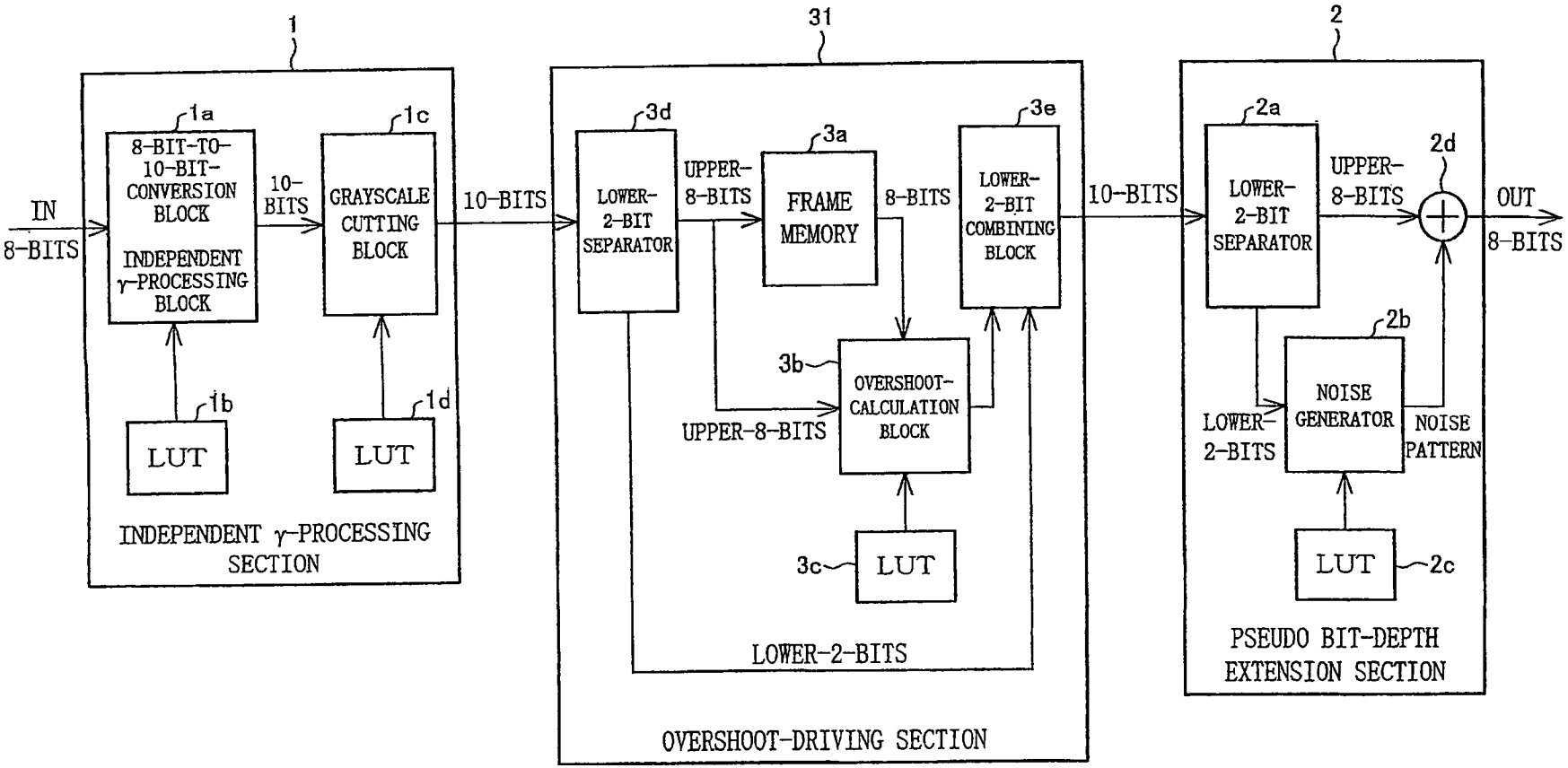
FIG. 2 is a circuit block diagram showing Embodiment 2 of the driving system in accordance with the present invention.

FIG. 2 is a schematic diagram illustrating a driving system according to Embodiment 2 of the present invention, provided in a liquid crystal display. The driving system of the embodiment 2 includes an independent γ-processing section 1, an overshoot-driving section 31 (instead of an overshoot-driving section 3 in Embodiment 1), and a pseudo bit-depth extension section 2, each of the sections being connected in this order.

The overshoot-driving section 31 is supplied with 10-bit data, and divides the data into upper-8-bit data and lower-2-bit data by a lower-2-bit separator 3*d*. Then, the upper-8-bit data is subjected to the foregoing calculation as described in Embodiment 1. An overshooting parameter is 8-bit data, which is stored in an LUT 3*c* in the overshoot-driving section 31.

The lower-2-bit data passes through the overshoot-driving section 31 without being processed. Then, in a lower-2-bit combining block 3*e*, the lower-2-bit data is added to and combined with the upper-8-bit data having been through the calculation. As a result, 10-bit data is outputted from the overshoot-driving section 31.

The 10-bit data from the overshoot-driving section 31 is supplied to the pseudo bit-depth extension section 2, and is outputted as 8-bit data. Here, a noise pattern whose noise amount is 1 or less is added to the least significant-bit of the output 8-bit data, in accordance with (i) information of the lower-2-bit of the input 10-bit data, (ii) a local coordinate of the data when the display area is divided into specific sized minute regions, and (iii) a value of the frame counter of the circuit.

The size of a minute region is 8 pixels×8 pixels×RGB, and the frame counter is reset every 8 frames. The driving system preferably further includes an independent γ-processing section 1, having a function of converting input 8-bit data into the 10-bit data before the data is supplied to the following pseudo bit-depth extension section 2 and the overshoot-driving section 3. The independent γ-processing section 1 includes (i) an independent γ-processing block 1*a* for converting 8-bit input grayscales into 10-bit data, and (ii) a grayscale cutting block 1*c* for cutting off some of the grayscale levels of the converted input signal, or for compressing the converted input signal to a signal including a region not containing the grayscales.

The Orders in layout (orders in processing) of the independent γ-block 1*a* and the grayscale cutting block 1*c* may be swapped according to the demands for the circuits. Idealistically, the independent γ-block 1*a* and the grayscale cutting block 1*c* carry out their conversion operations with calculations. However, to allow individual adjustment for each model, conversion rules of the independent γ-block 1*a* and the grayscale cutting block 1*c* are preferably stored in LUTs 1*b* and 1*d* separately.

As described, in a signal processing of the first embodiment, for example, a signal representing the inputted 8-bit data is first inputted to the independent γ-processing section 1. The 8-bit data is then extended to the 10-bit data. Then, in the grayscale cutting block 1*c*, the 10-bit data is compressed to a signal whose grayscale ranges from a 32nd grayscale to a 992nd grayscale, and is outputted. As described, the 10-bit data obtained after the γ-processing and the compression is outputted from the independent γ-processing section 1 as a 10-bit data signal. This 10-bit data signal is then sent to the overshoot-driving section 31.

The overshoot-driving section 31 reads out the overshooting-parameter from the LUT 3*c* according to the upper-8-bit data of the input 10-bit data signal and the processed 8-bit data and the lower-2-bit data of the input 10-bit data are combined together. The resulting data is then outputted to the pseudo bit-depth extension section 2.

In the pseudo bit-depth extension section 2, the inputted 10-bit data signal is converted into an 8-bit data signal whose grayscale ranges from an 8th to a 248th grayscales. This 8-bit data signal is outputted, with the optimum noise pattern added thereto. A noise pattern, whose noise amount is 1 or less generated, from the pseudo bit-depth extension section 2, as 8-bit-data representing 10-bit information. The noise pattern is generated, based on the foregoing conversion rules, with a noise amount not more than 1.

As described, in the foregoing Embodiments 1 and 2, the ultimate output is the 8-bit data signal that represents information of 10-bit data. Accordingly, the driving system described in Embodiment 1 or 2 is an 8-bit driving system that is capable of reproduction based on 10-bit data.

Figure 17:
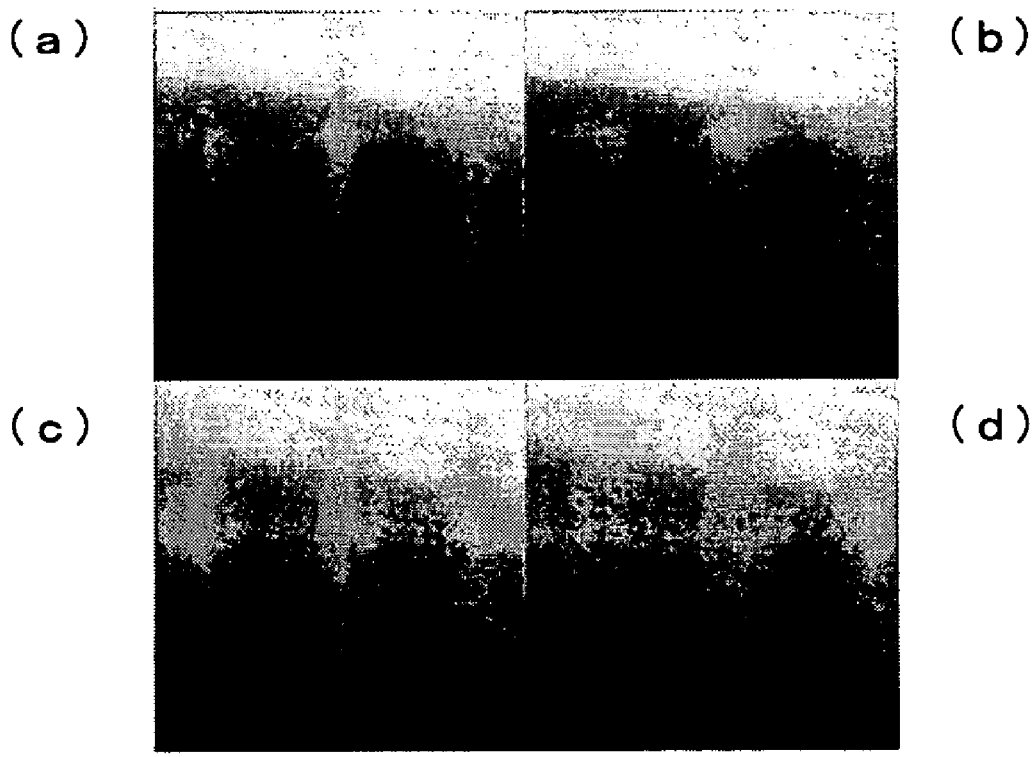
FIG. 17 shows samples of gradations used for evaluation in image reproduction quality of the driving system in accordance with the present invention.

The driving systems of the Embodiments 1 and 2 were respectively mounted in the LCDs, and the gradation pattern shown in FIG. 17(*a*) was displayed in those systems. This gradation pattern is reproduced from the 8-bit data externally supplied to the LCDs. In this data, the upper-left portion is yellow, the lower-right portion is blue, the lower-left is a dark portion, and the upper-right portion is a bright portion. The gradation itself show direct reflection of the smoothness of γ-curve. The LCD used here is for HDTV (High Definition Television), and performs display by a dot-inversion driving method. For comparison, a similar observation was conducted with respect to a real-8-bit data driving system (first comparative example; see FIG. 20) having no function of extending 8-bit-data to 10-bit data.

Figure 18:
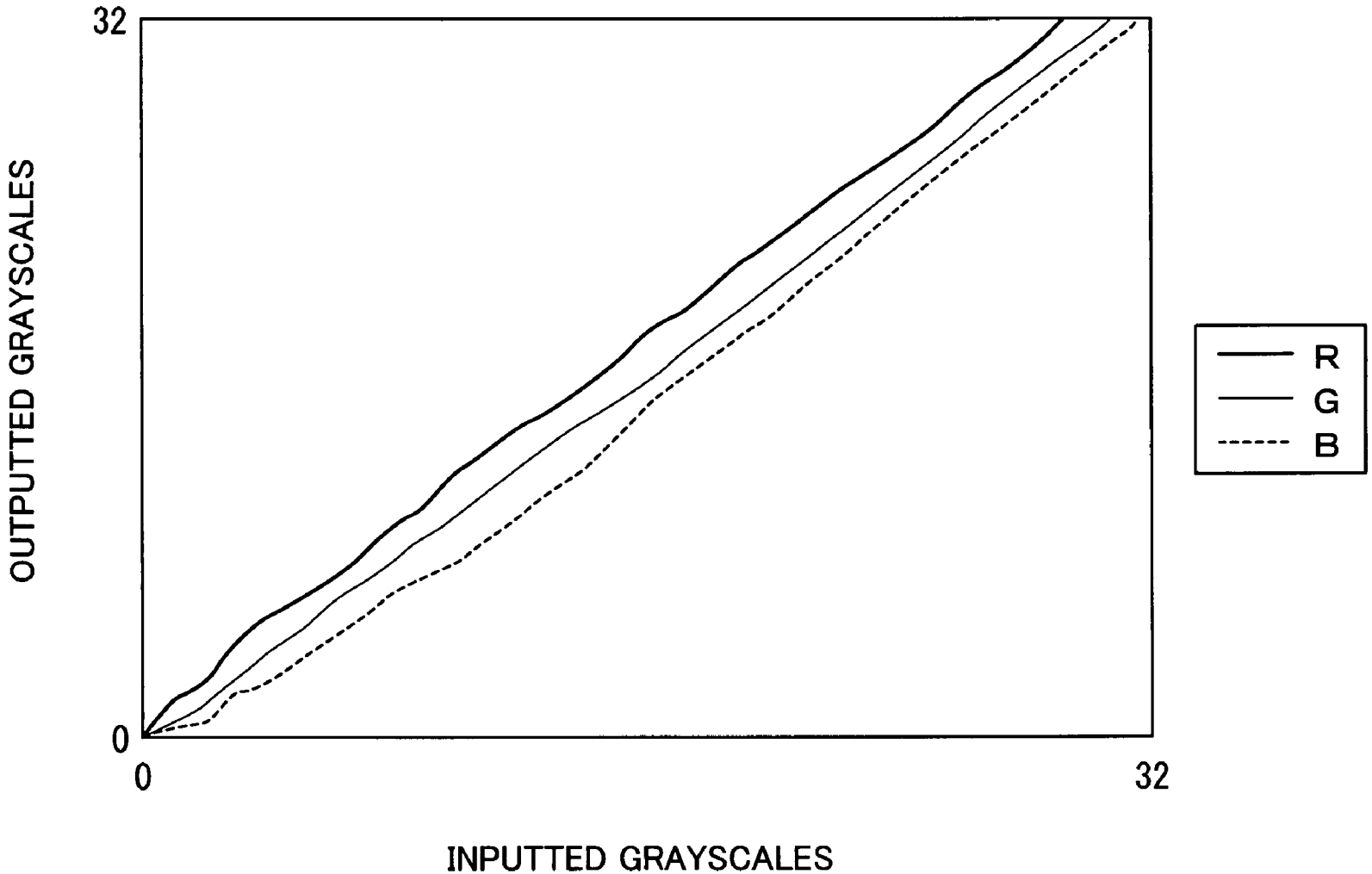
FIG. 18 is a graph according to the embodiments of the present invention, showing changes in grayscale of each color through an independent γ-processing that is performed after a pseudo bit-depth extension process.
Figure 19:
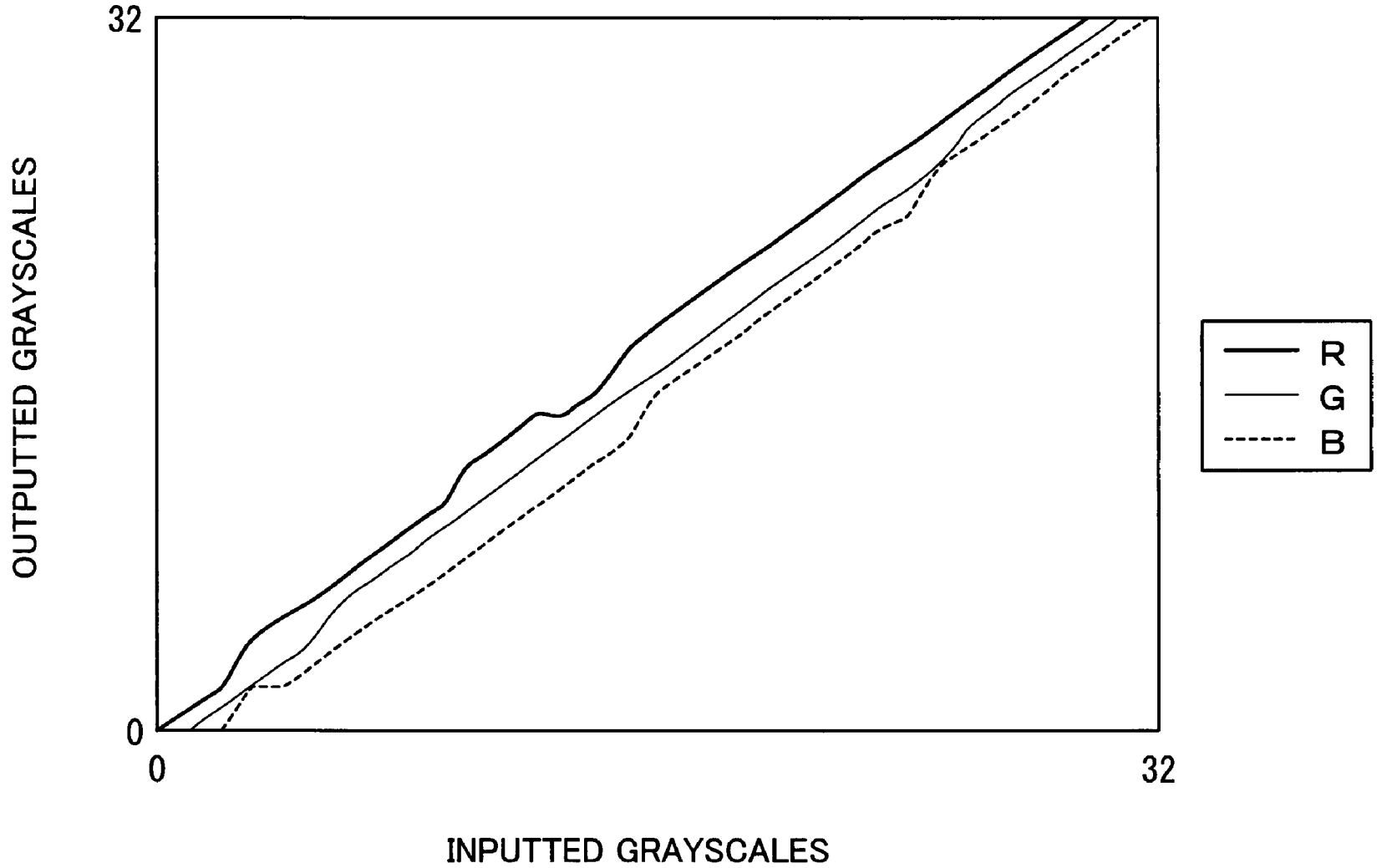
FIG. 19 is a graph of a second comparative example, showing changes in grayscale of each color through the independent γ-processing when the pseudo bit-depth extension process is not performed therebefore.
Figure 20:
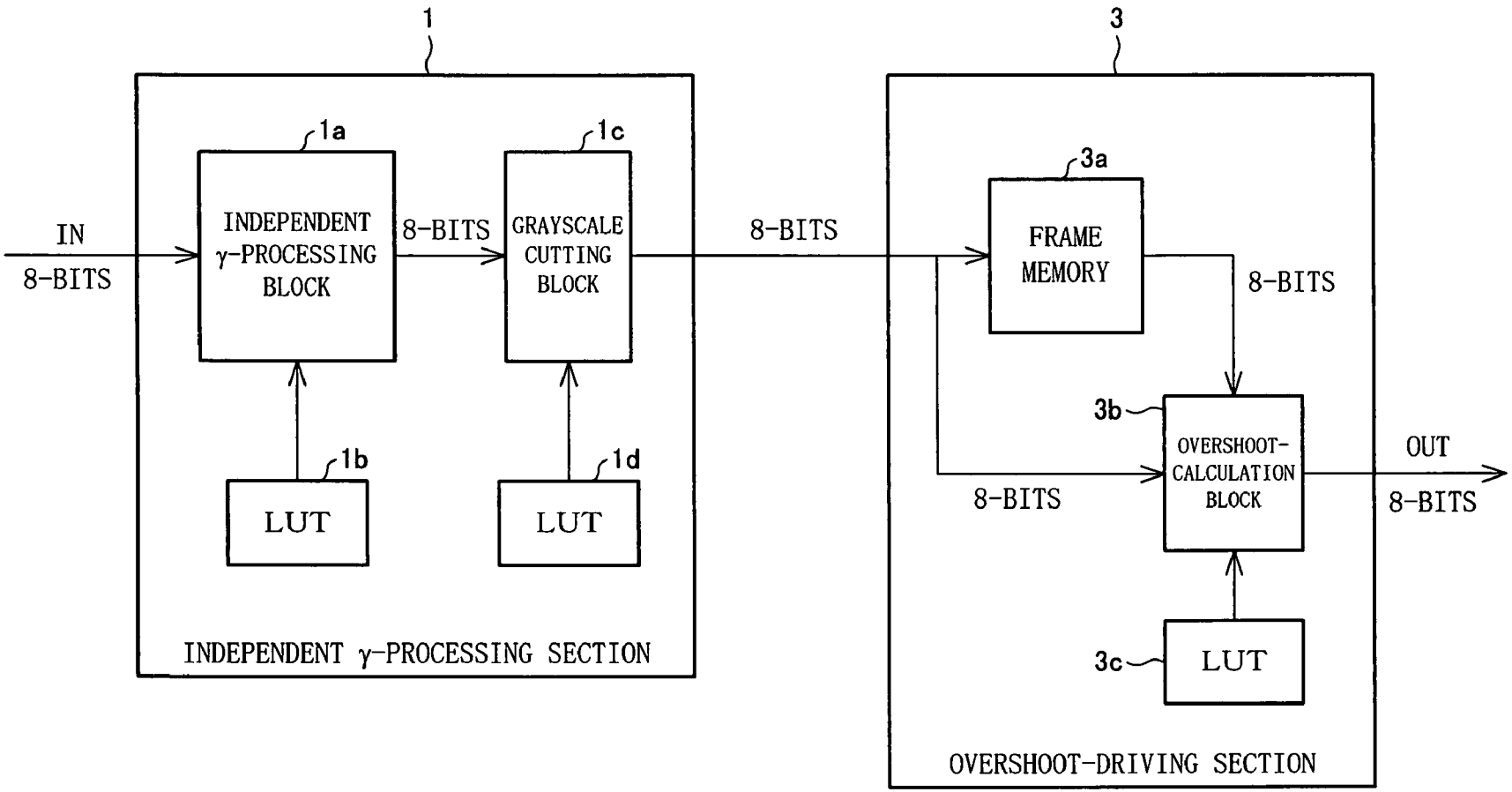
FIG. 20 is a circuit-block diagram showing as the first comparative example a real 8-bit driving system having an independent γ-processing function.

As a result, as shown in FIG. 19, with the real-8-bit data driving system, the displayed gradation was not as smooth as the gradation shown in FIG. 17(*b*). This is attributed to an irregular γ-curve due to the independent γ-process. In the driving systems of the Embodiments 1 and 2 in which bit-number is extended to the 10-bit data, the γ-curve was as smooth as that of FIG. 18, even after the independent γ-process was carried out. Thus, as shown in FIGS. 17(*c*) and (*d*), more natural gradations were obtained. Note that, no difference was seen between the respective displays according to Embodiments 1 and 2.

Next, the gradation pattern was scrolled to confirm the effect of the present invention. The scrolling of the gradation pattern causes the following phenomena, thereby enhancing influence of the noise used in the pseudo bit-depth extension. The influence of noise is first described with a simple example.

First, the gradation pattern of 8-bit data shown in FIG. 14(*a*) is converted into a gradation pattern of 10-bit data shown in FIG. 14(*b*). For convenience, the gradation values are expressed on the basis of 8-bit data. Then, the gradation is scrolled towards the upper-left as shown in FIGS. 15(*a*) and (*b*). Here, if a gradation pattern of real 10-bit data is displayed, the scrolling does not cause any problems in the quality of the reproduction. However, since this gradation is obtained by converting 8-bit data into pseudo 10-bit data through the pseudo bit-depth extension, the following problems in image display occurs due to the system in which the 8-bit data (i.e. base grayscales), and (b) a noise pattern made of 0 or 1 having a time period are combined.

As shown in FIGS. 16(*a*) and 16(*b*), in a shaded region, particularly in the region painted black, the noise pattern causes 2 levels change in gradation even though this noise pattern is supposed to cause 1 level change. This is attributed to the changes in base grayscales in noise pattern caused by the scrolling. This phenomenon in these black regions periodically appears regardless of the setting of noise pattern, and therefore is observed as a stripe.

If the stripe is significant, it becomes a serious problem in a LCD in which a high-performance is assured. However, the stripe was barely noticeable in both Embodiments 1 and 2. Thus, the high quality of the image reproduction was ensured.

Further, the stripe was barely noticeable in both Embodiments 1 and 2 with or without the overshoot-driving process; therefore, both of Embodiments 1 and 2 ensure high display quality.

Further, another observation was conducted in Embodiments 1 and 2, with a natural image. As a result, the systems of Embodiments 1 and 2 both produced a smooth γ-curve even after the independent γ-process was carried out, without causing any color fading or degradation in tone, thereby obtaining a high-quality image. Further, the influence of noise used in the pseudo bit-depth extension was not seen in both Embodiments 1 and 2, and the qualities of the images were substantially the same.

Here, for the systems according to Embodiments 1 and 2, an evaluation was carried out with respect to the gradation pattern, by generating a noise whose noise amount=2 by the pseudo bit-depth extension section 2. As a result, in the system of Embodiment 2, the periodical noise became significant when the gradation was scrolled. The periodical noise was even more significant in the system of Embodiment 1.

Further, in Embodiments 1 and 2, a size of a region where the noise pattern is generated is changed to 2×2×RGB, 4×4×RGB, 16×16×RGB, and 32×32×RGB, and a similar evaluation was carried out by scrolling the gradation. As a result, in the case of 2×2×RGB, the effect of the pseudo bit-depth extension was not sufficient. Further, in the case of 32×32×RGB, the effects of the pseudo bit-depth extension was sufficient, however a size of the circuit became excessively large.

Further, another similar evaluation was carried out in the system of Embodiments 1 and 2, by scrolling the gradation using different periods of repeating the noise patterns, every 4 frames, 8 frames, 16 frames, and 32 frames.

As a result, in the case where the noise patterns were repeated every 4 frames, half of the noise patterns disappeared when, for example, a pseudo-impulse driving was carried out, thus failing to obtain sufficient effect of the pseudo bit-depth extension. Half of the noise patterns also disappeared for the noise patterns with a period of 8 frames or greater when the pseudo-impulse driving was carried out; however, the effect was sufficient in the remaining half. Further, in the case where the noise patterns have a period of 32 frames, sufficient effects of the pseudo bit-depth extension was obtained; however the size of the circuit became excessively large.

Here, the systems of Embodiments 1 and 2 both require at least four LUTs including (a) an LUT for storing signal conversion rules applied in the grayscale cutting block, (b) an LUT for storing conversion rules applied in the independent γ-processing block, (c) an LUT for storing conversion rules applied in the overshoot-driving block, and (d) an LUT storing the noise patterns for the pseudo bit-depth extension section 2. As a result, the required memory amount for the circuit increases.

In view of the foregoing problem, the present invention provides still another system in which some of the LUTs are combined, so that the number of the LUTs is reduced. Here, since the LUT provided in the pseudo bit-depth extension section 2 has different characteristics from those of the other LUTs, there is a difficulty in combining the LUT with the others.

Embodiment 3

Figure 3:
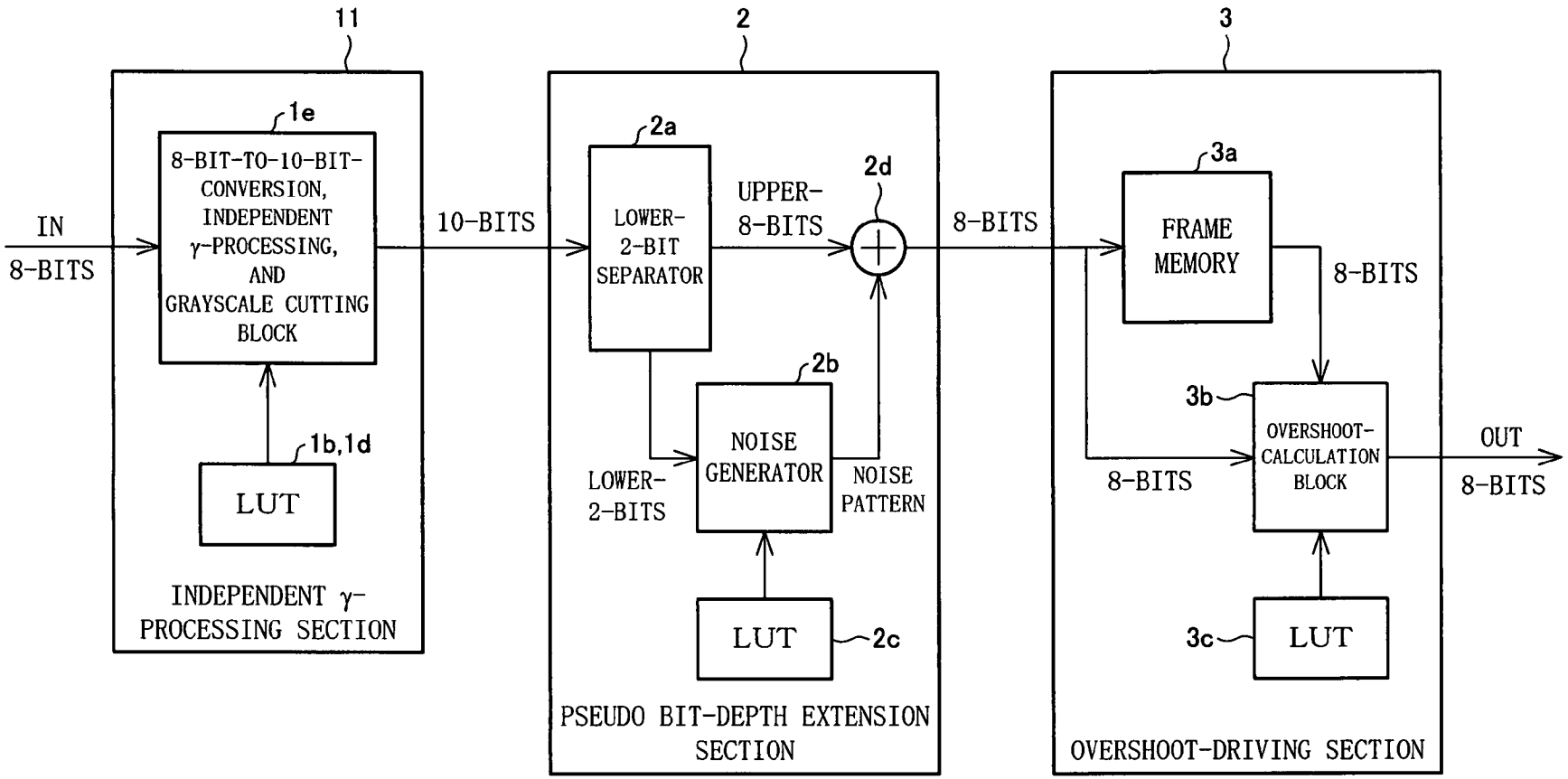
FIG. 3 is a circuit block diagram showing Embodiment 3 of the driving system in accordance with the present invention.
Figure 4:
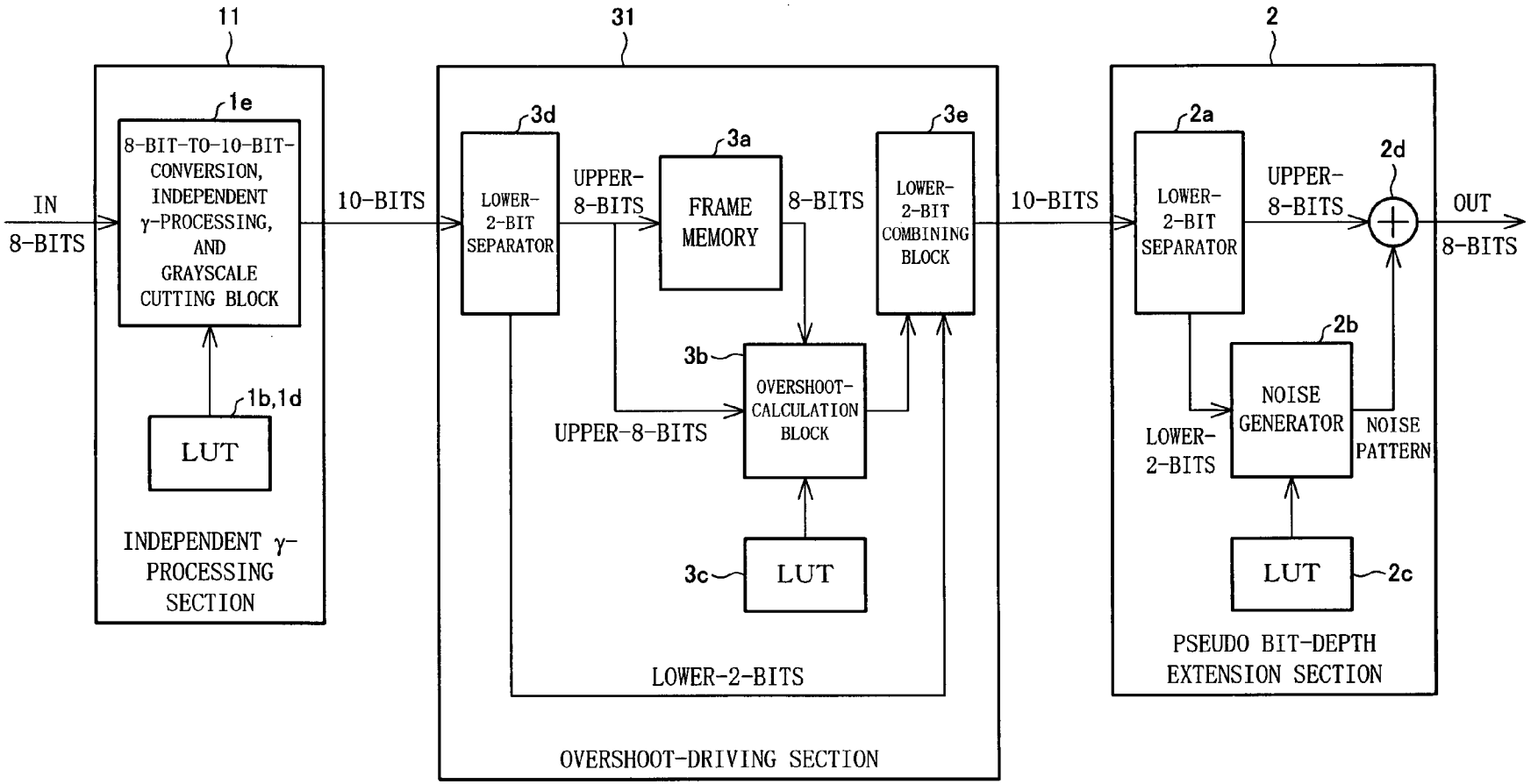
FIG. 4 is a circuit block diagram showing an alternative form of Embodiment 3.

The foregoing system is described below as Embodiment 3 of the present invention. As shown in FIGS. 3 and 4, the LUT 1*b* for the independent γ-processing block 1*a* and the LUT 1*d* for the grayscale cutting block 1*c*, each of which provided in the independent γ-processing section 1 of Embodiments 1 and 2, are combined with each other, and the combined block is contained in an block 1*e*, together with an LUT, which is a combined memory of the LUT 1*b* and the LUT 1*d*. The block 1*e* is provided in a preceding stage of the pseudo bit-depth extension section 2. This arrangement requires only three LUTs, that is, one of the LUTs is omitted.

Embodiment 4

Figure 5:
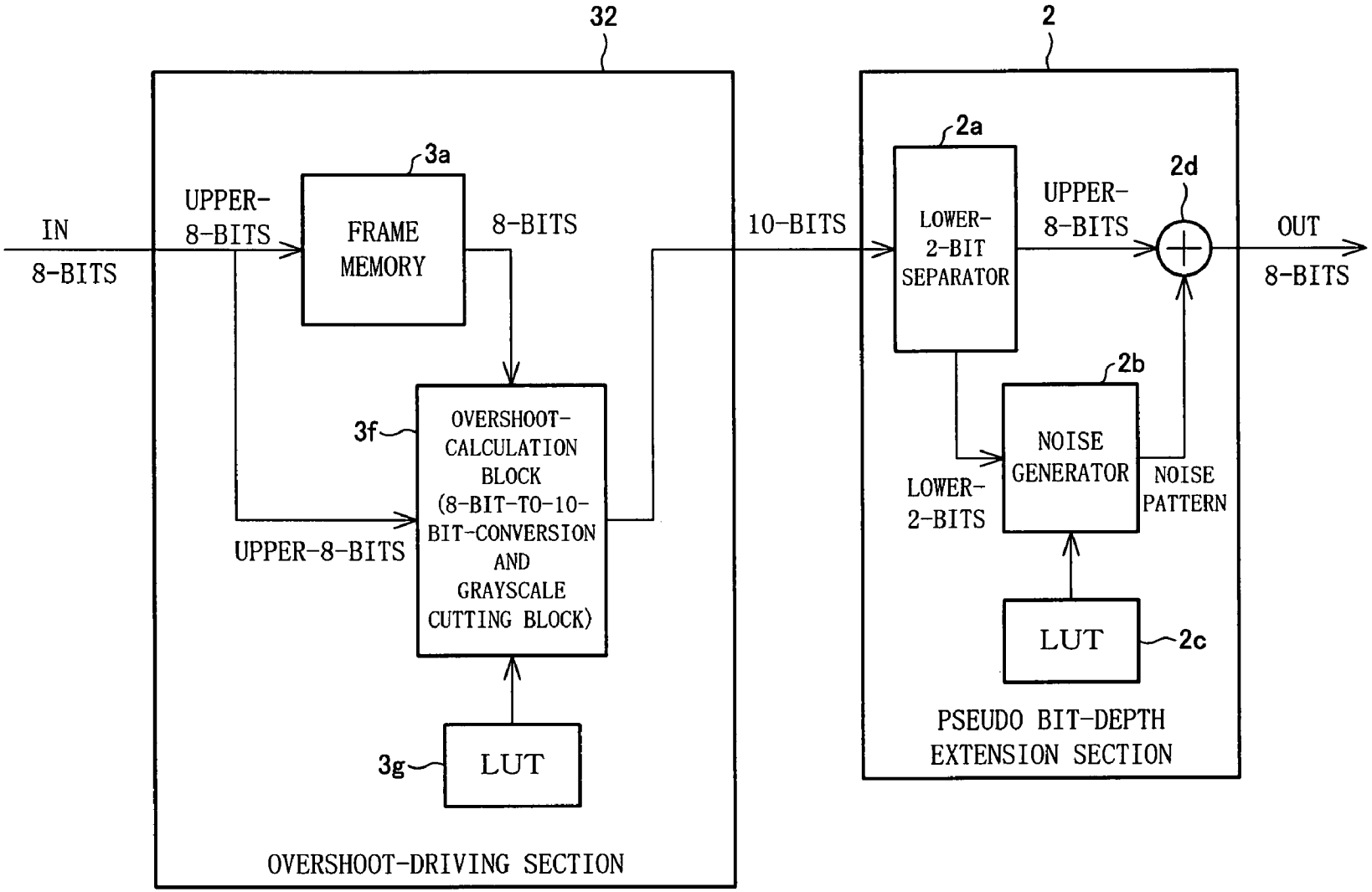
FIG. 5 is a circuit block diagram showing Embodiment 4 of the driving system in accordance with the present invention.

Yet another system is described below as Embodiment 4 of the present invention. As shown in FIG. 5, in this embodiment, there is provided an overshoot-driving section 32 that contains an overshoot-calculation block 3*f* and a unified LUT 3*g*. The overshoot-calculation block 3*f* is a combination of the independent γ-processing section 1 and the overshoot-driving section 31 of the second embodiment, and therefore has (a) an overshoot-calculation function, (b) an 8-bit-to-10-bit conversion function, and (c) a grayscale cutting function. The unified LUT 3*g* is a combined LUT 3*g* of the LUTs 3*c*, 1*b* and 1*d*, and stores 10-bit data. Further, the pseudo bit-depth extension section 2 is provided in a following stage of the overshoot-driving section 32. This arrangement requires only two LUTs.

Such combination of the LUT 3*c* of the overshoot-calculation section 31 and the LUTs 1*b* and 1*d* of the independent γ-processing section 1 in the system of Embodiment 1; and therefore, the layout of the combination is difficult to realize in the system of Embodiment 1. Accordingly, the arrangements of Embodiments 3 and 4 should be selectively adopted in consideration of the arrangement of circuit and the capacity of memory.

The driving systems according to Embodiments 1 through 4 of the present invention are respectively mounted in separate LCDs, so as to display the gradation patterns shown in FIG. 18, with a result that all of the systems display natural gradation. Further, there is no difference in display between those systems.

Further, an observation was carried out by scrolling the gradation in each of the embodiments. As a result, in spite of ON/OFF operations in the overshoot-driving process, the influence of noise used in the pseudo bit-depth extension was not seen in any of the embodiments.

Further, another observation was conducted in each of the foregoing embodiment, with a natural image. As a result, the systems of the Embodiments all produced a smooth γ-curve even after the independent γ-process was carried out, without causing any color fading or degradation in tone, thereby obtaining a high-quality image. Further, the influence of noise used in the pseudo bit-depth extension was not seen in any of the Embodiments, and the qualities of the images were substantially the same.

Next, in each system of Embodiments 1 through 4, response speed of the LCD was measured. The measurement was carried out for both cases (a) performing the overshoot-driving and (b) not performing the overshoot-driving. For comparison, response speed was also measured for a driving system in which the grayscale cutting block is omitted (second comparative example; see FIG. 21). In this driving system shown in FIG. 21, the independent γ-processing section 12 has no function of cutting the grayscales.

Figure 21:
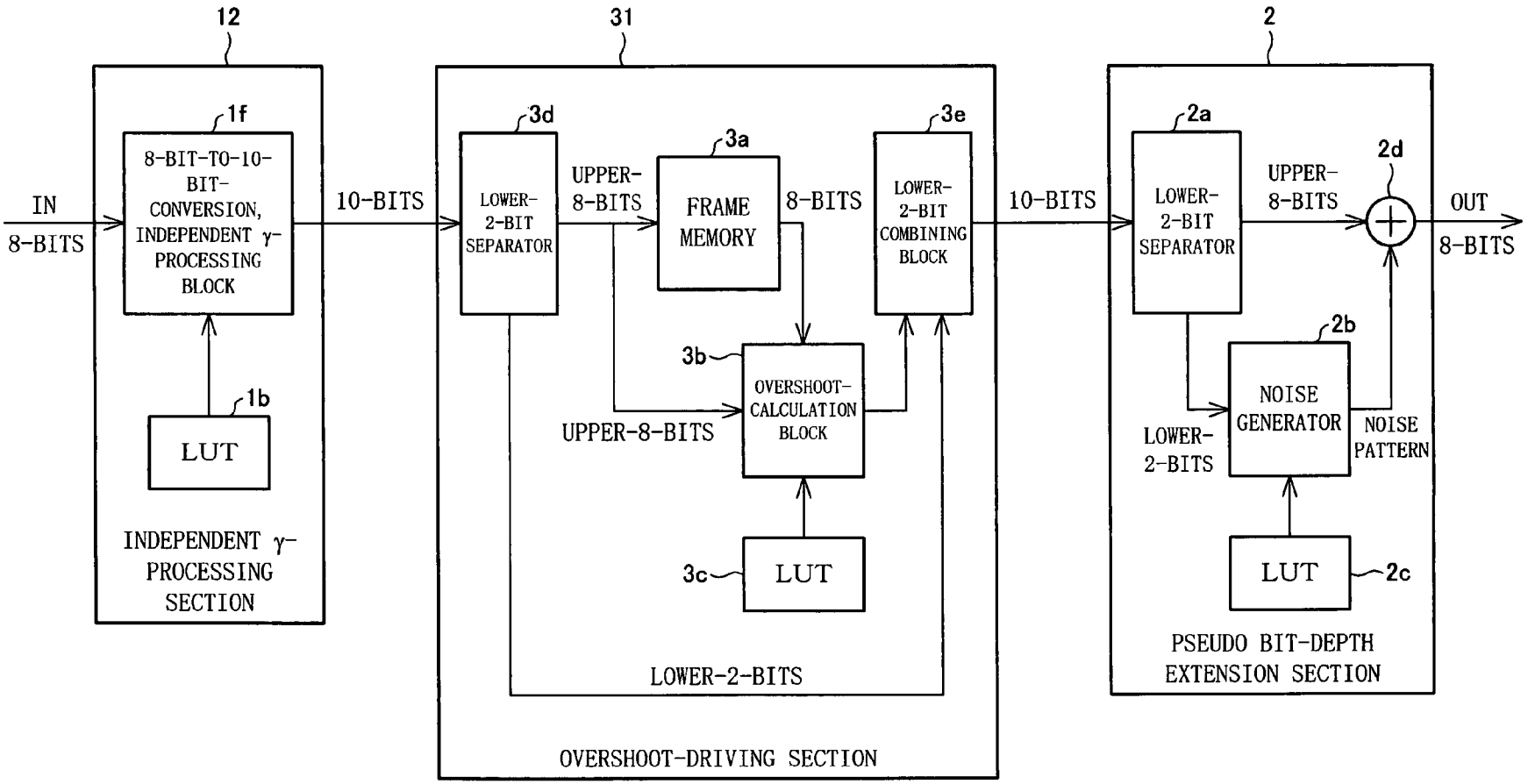
FIG. 21 is a circuit-block diagram showing as the second comparative example a driving system having no grayscale cutting function.
Figure 23:
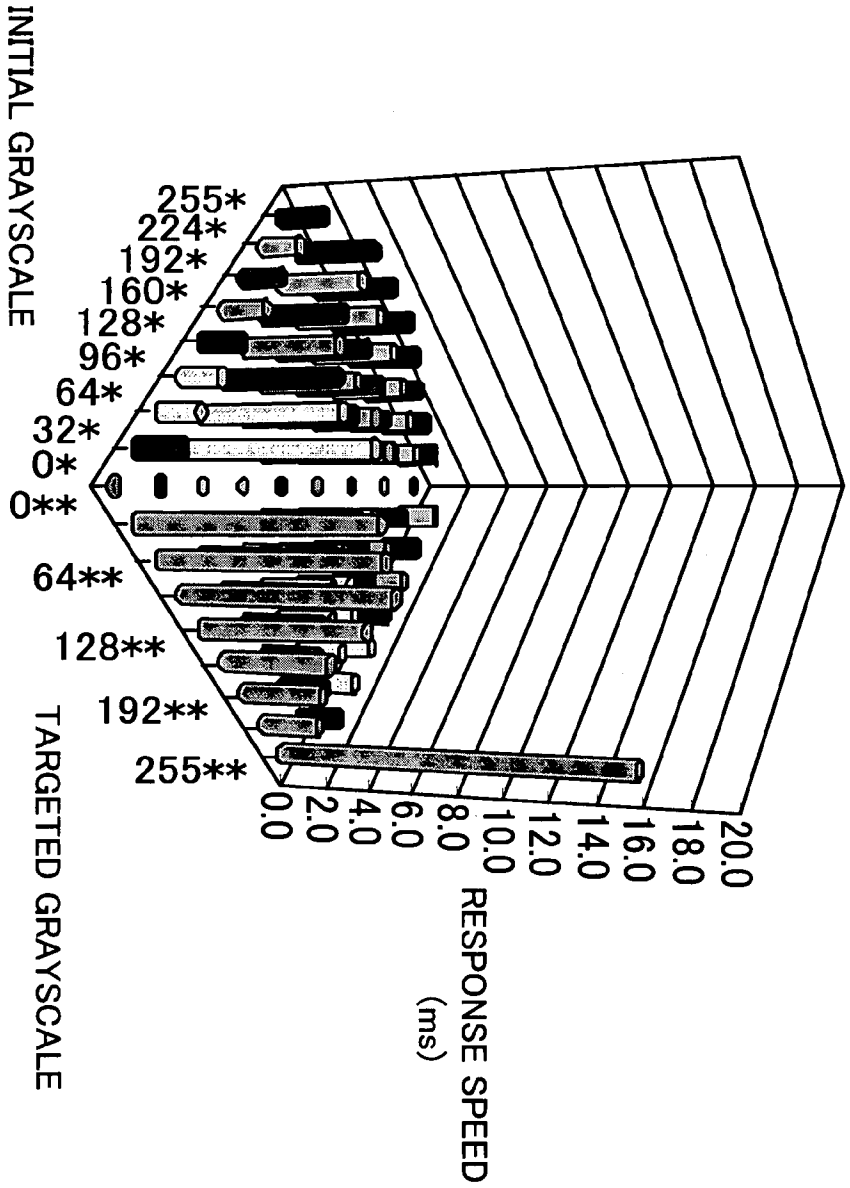
FIG. 23 is a graph showing distribution of response speed in a driving system of the second comparative example having no grayscale cutting function.

As a result, with the driving system shown in FIG. 21, the overshoot-driving did not make a significant improvement in response speed in transition in the vicinity of the 0th grayscale or in transition in the vicinity of the 255th grayscale. Accordingly, as shown in FIG. 23, the response speed hardly changes with or without enforcement of the overshoot driving in most of the regions including the vicinity of the 0th and the vicinity of the 255th grayscale. However, the overshoot-driving was effective for the response speed in transition among intermediate grayscales, and the response speed in those regions was significantly increased compared to the response speed when the overshoot-driving was not performed.

Figure 22:
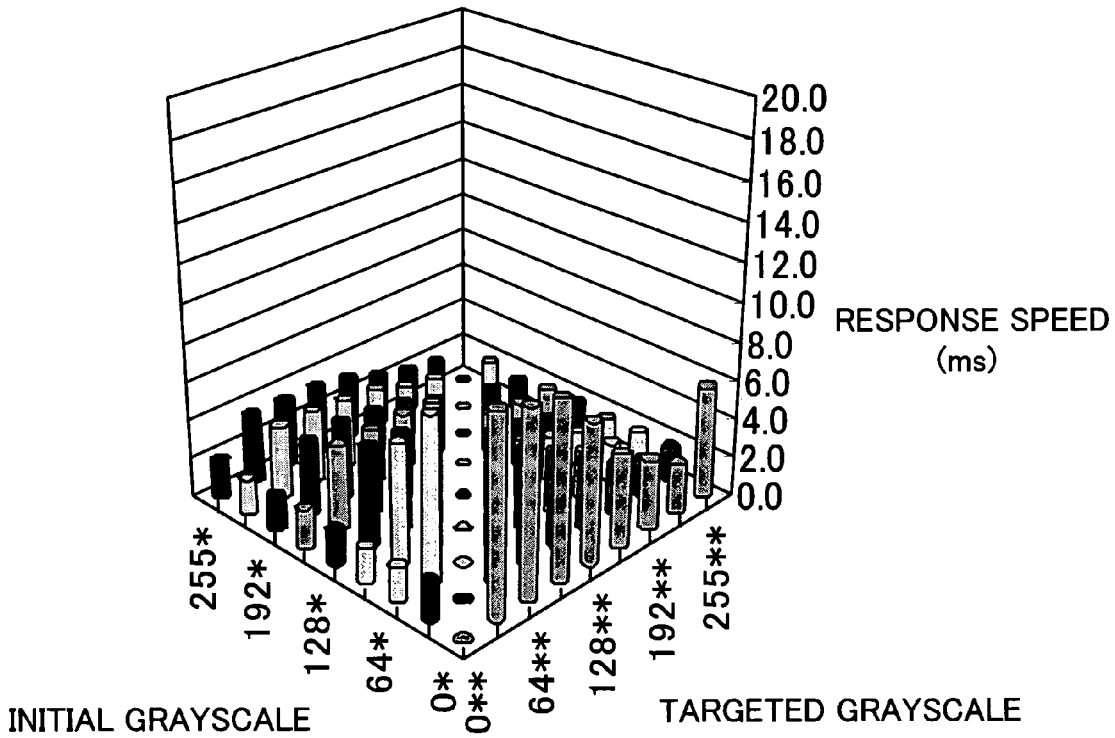
FIG. 22 is a graph showing distribution of response speed in a driving system of the present invention having the grayscale cutting function.

On the other hand, the overshoot-driving was effective for all ranges of grayscale in any of the systems of Embodiments 1 through 4. This is because the grayscale cutting block reserves a lower voltage region of the 0th grayscale and an upper voltage region of the 255th grayscale to use these regions for the overshoot-driving, thereby ensuring the effect of overshoot-driving for all ranges of grayscale. Thus, as shown in FIG. 22, the response speed was accelerated by the overshoot-driving in all grayscale transitions compared to the case where the overshoot-driving was not performed.

Next, in each of the systems of Embodiments 1 through 4, the quality of the image reproduction was evaluated by varying the default setting of the γ-value in the respective displaying sections. However, the independent γ-processing sections 1 and 11 do not cause any changes in the default setting of the γ-value. In the evaluation, the γ-value was set to 2.0, 2.2, 2.5, 2.8, 3.0, and 3.2 and image quality for each value was evaluated.

As a result, black was insufficiently reproduced in the case of γ=2.0, and therefore the resulting image was not up to standard. In the case of γ=2.2, though the quality of image was passable, black-sided grayscales were slightly too bright because 8 levels of the black-sided grayscales were cut off by the grayscale cutting block. This caused deterioration in contrast of the image. In addition to this, the black-sided grayscales were insufficiently expressed. In the cases of g=2.5, 2.8, or 3.0, the quality of the displayed image was well up to standard with sufficient reproduction of black-sided grayscales and adequate brightness of the black-sided grayscales. In the case where γ=3.2, the brightness of the black-sided grayscales were too dark, decreasing the quality of image to an unallowable level. In all of the cases, the characteristics of γ-values of the grayscale display regions were smaller than the default γ-value.

Next, in each of the systems of Embodiments 1 through 4, the quality of image reproduction was evaluated with the foregoing γ-value characteristics 2.5, 2.8, and 3.0 that ensured sufficient quality in the above evaluation. Further, the γ-value characteristics in the grayscale display regions were set higher than the default γ-value by the independent γ-processing sections 1 or 11. As a result, superior reproduction was obtained for each γ-value characteristic, and the reproduction quality was increased after γ-correction was carried out by the independent γ-processing section 1 or 11.

The following describes specific arrangements of the foregoing Embodiments 1 through 4 of the present invention.

Embodiment 5

Figure 6:
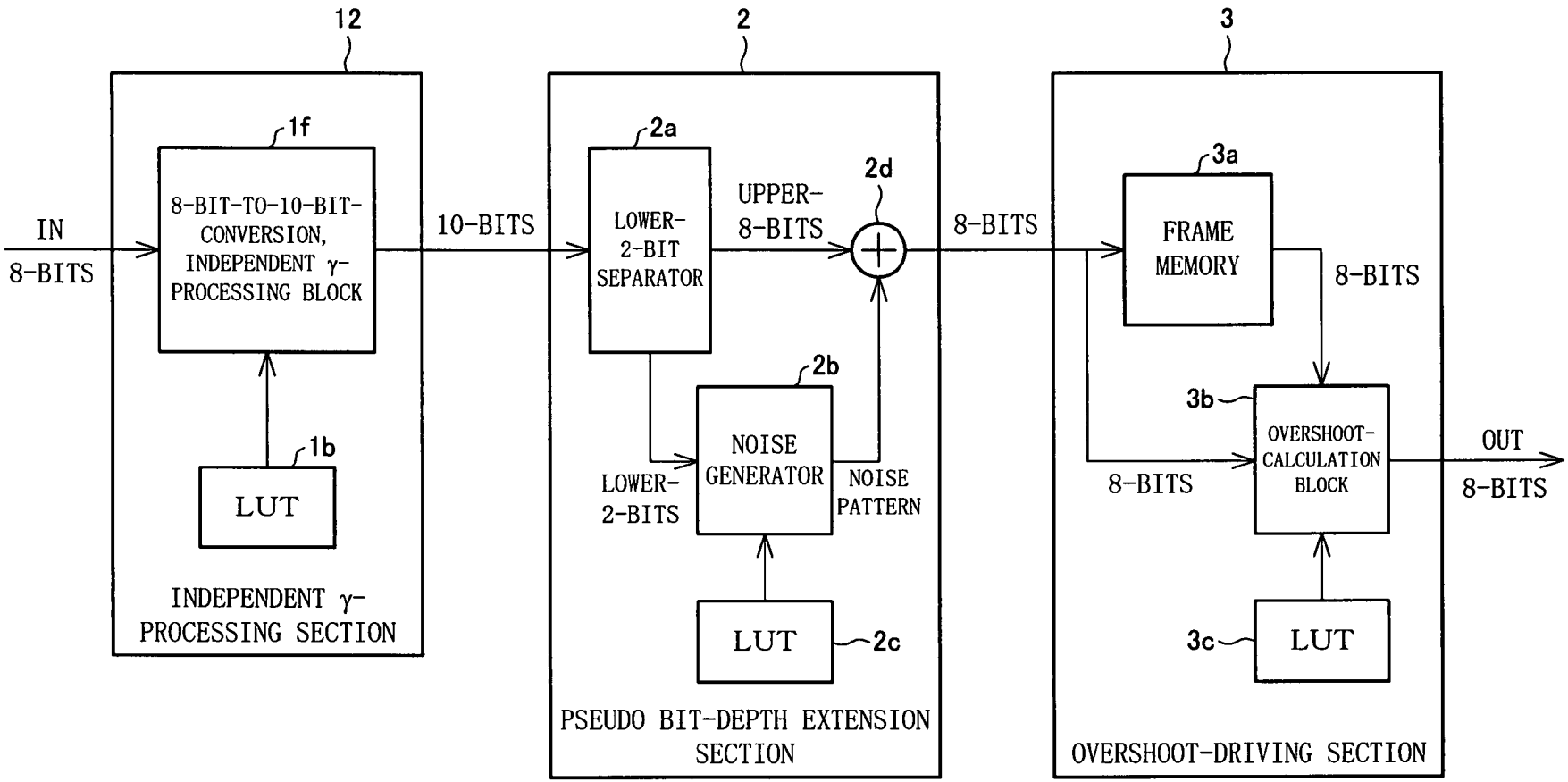
FIG. 6 is a circuit block diagram showing Embodiment 5 of the driving system in accordance with the present invention.

FIG. 6 shows a system according to Embodiment 5 of the present invention. The system includes an independent γ-processing section 12, a pseudo bit-depth extension section 2, and an overshoot-driving section 3, each of which are arranged in this order. In this system, the output of the pseudo bit-depth extension section 2 is used as the previous frame data for use in the overshoot-driving section 3, which output is 8-bit data stored in the frame memory 3*a*.

Embodiment 6

Figure 7:
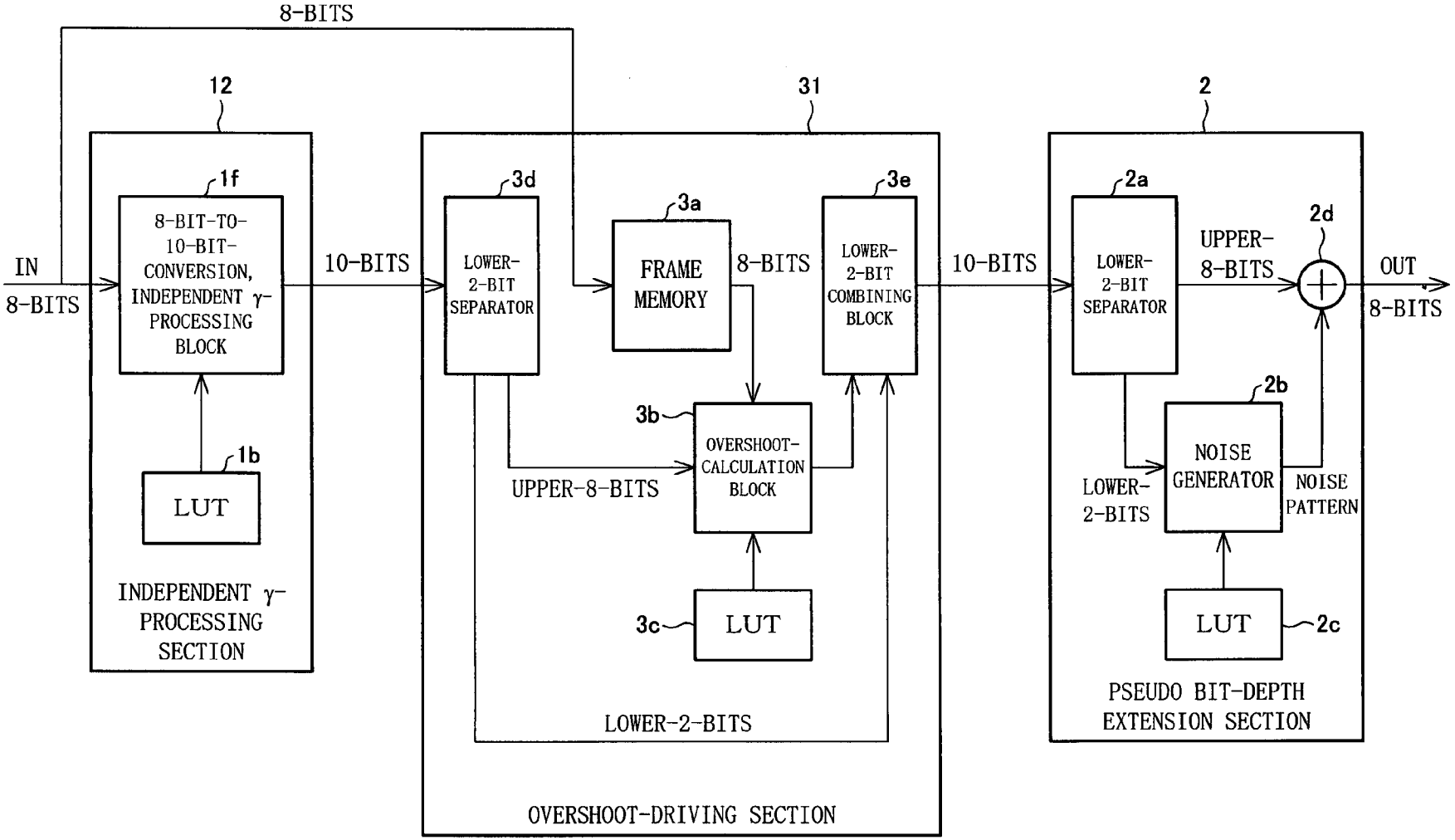
FIG. 7 is a circuit block diagram showing Embodiment 6 of the driving system in accordance with the present invention.

FIG. 7 shows a system according to Embodiment 6 of the present invention. The system includes an independent γ-processing section 12, an overshoot-driving section 31, and a pseudo bit-depth extension section 2, each of which are arranged in this order. In this system, input 8-bit data for the independent γ-processing section 12 is used as the previous frame data for use in the overshoot-driving section 31, and therefore the 8-bit data is stored in the frame memory 3*a* before inputted to the independent γ-processing section 12.

Embodiment 7

Figure 8:
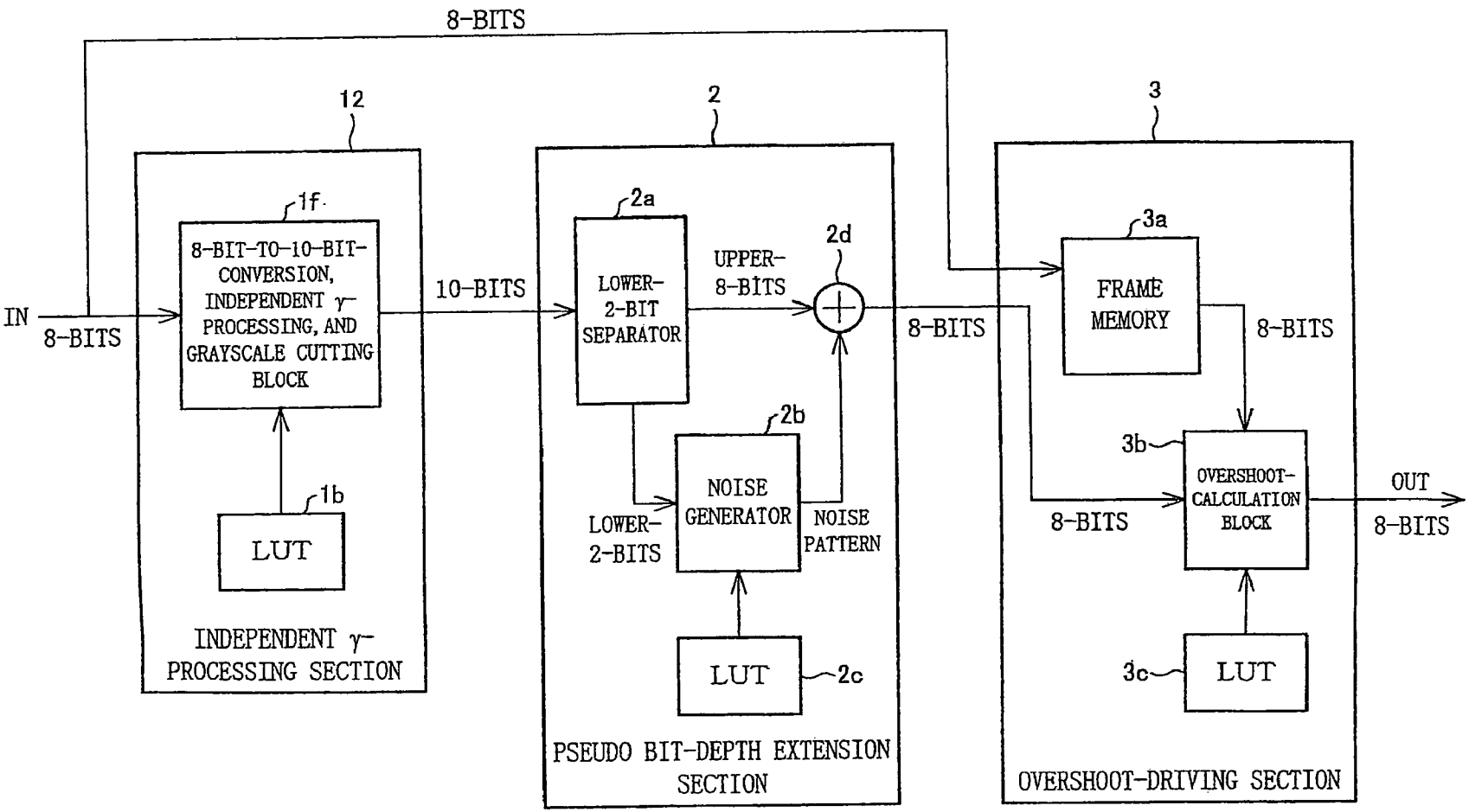
FIG. 8 is a circuit block diagram showing Embodiment 7 of the driving system in accordance with the present invention.

FIG. 8 shows a system according to Embodiment 7 of the present invention. The system includes an independent γ-processing section 12, a pseudo bit-depth extension section 2, and an overshoot-driving section 3, each of which are arranged in this order. In this system, input 8-bit data for the independent γ-processing section 12 is used as the previous frame data for use in the overshoot-driving section 3, and therefore the 8-bit data is stored in the frame memory 3*a* before inputted to the independent γ-processing section 12.

Embodiment 8

Figure 9:
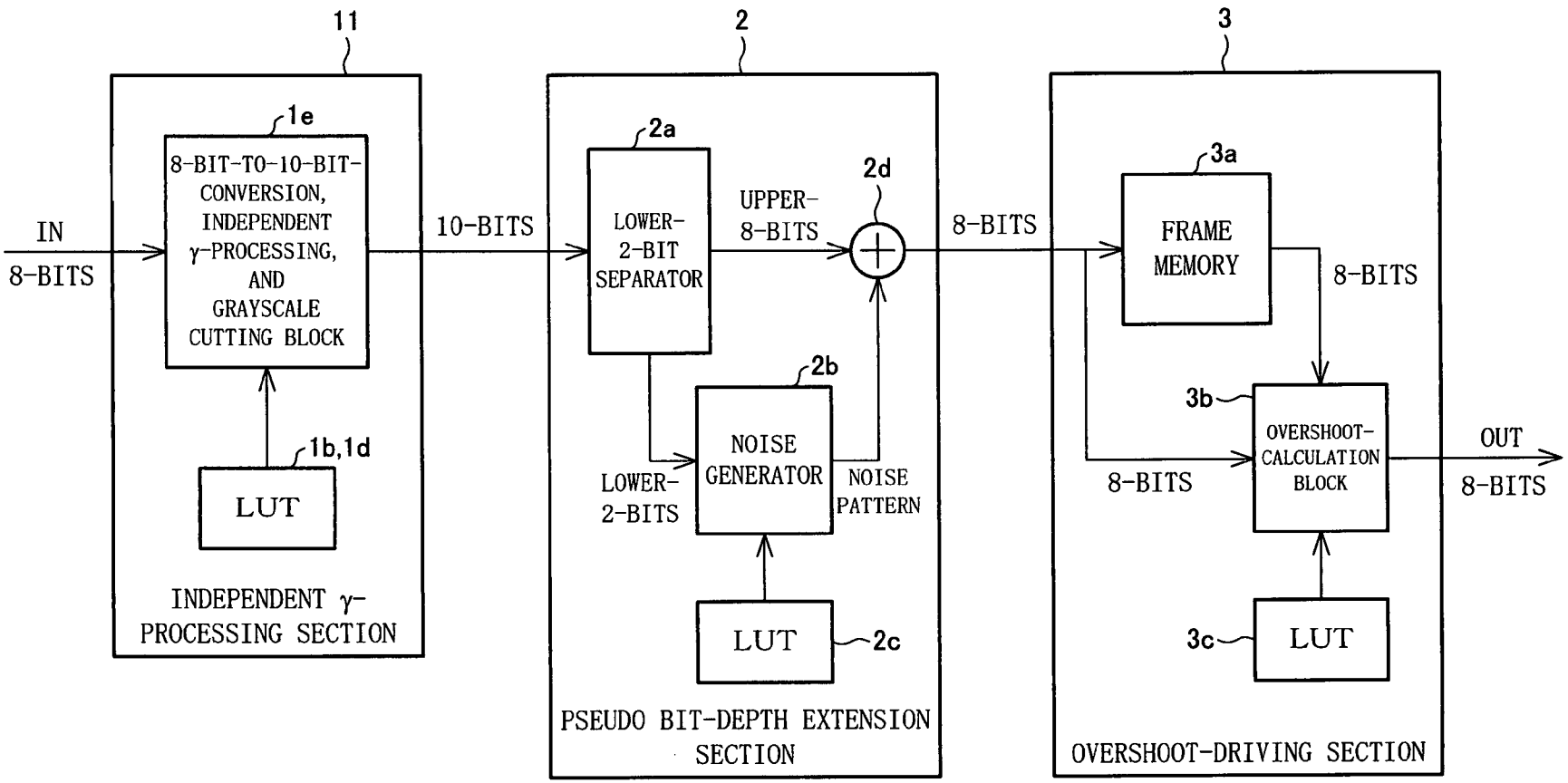
FIG. 9 is a circuit block diagram showing Embodiment 8 of the driving system in accordance with the present invention.

FIG. 9 shows a system according to Embodiment 8 of the present invention. The system includes an independent γ-processing section 11 (grayscale cutting block included), a pseudo bit-depth extension section 2, and an overshoot-driving section 3, each of which are arranged in this order. In this system, the output of the pseudo bit-depth extension section 2 is used as the previous frame data for use in the overshoot-driving section 3, which output is 8-bit data stored in the frame memory 3*a*.

Embodiment 9

Figure 10:
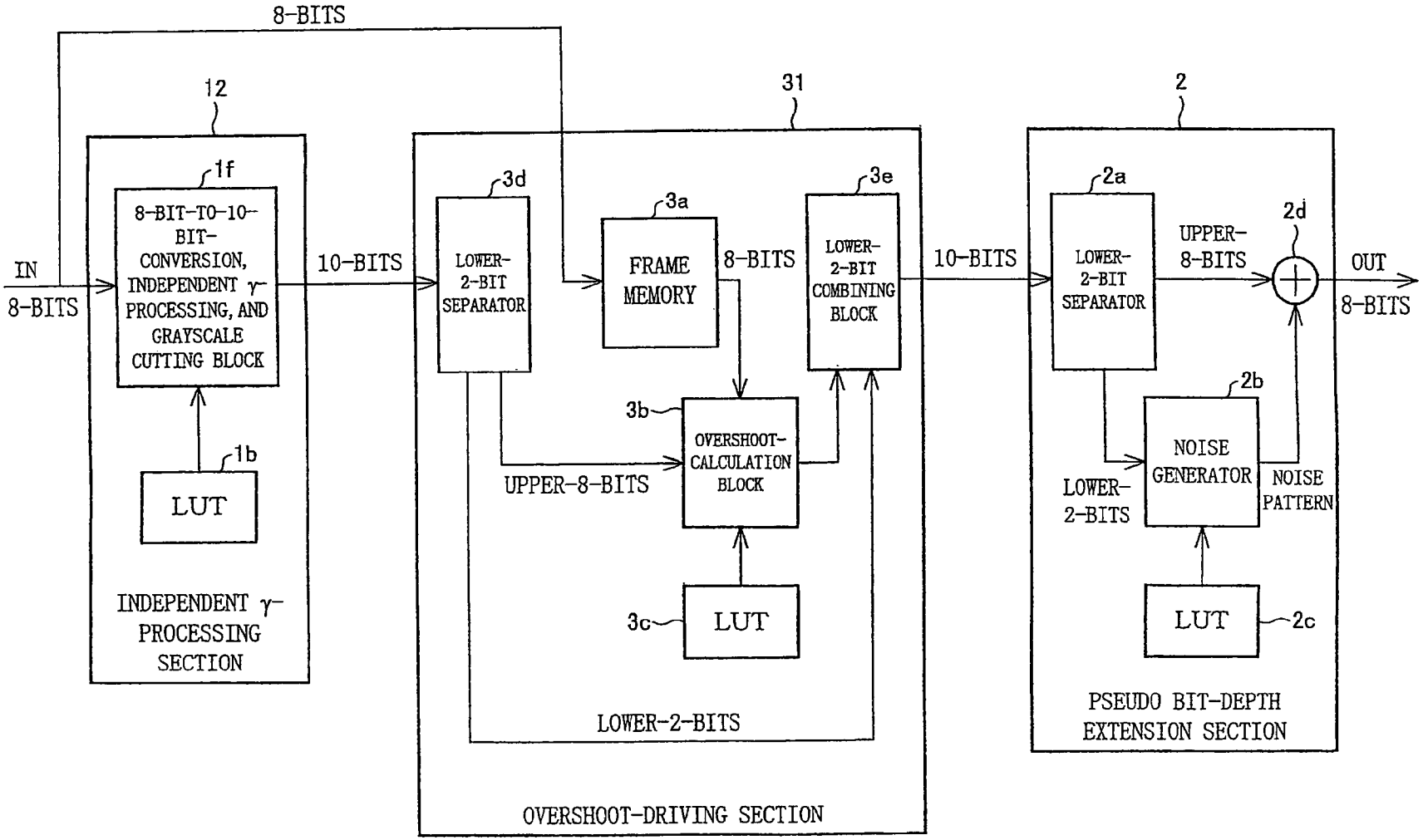
FIG. 10 is a circuit block diagram showing Embodiment 9 of the driving system in accordance with the present invention.

FIG. 10 shows a system according to Embodiment 9 of the present invention. The system includes an independent γ-processing section 12 (grayscale cutting block included), an overshoot-driving section 31, and a pseudo bit-depth extension section 2, each of which are arranged in this order. In this system, input 8-bit data for the independent γ-processing section 12 is used as the previous frame data for use in the overshoot-driving section 31, and therefore the 8-bit data is stored in the frame memory 3*a* before inputted to the independent γ-processing section 12 including a grayscale cutting function.

Embodiment 10

Figure 11:
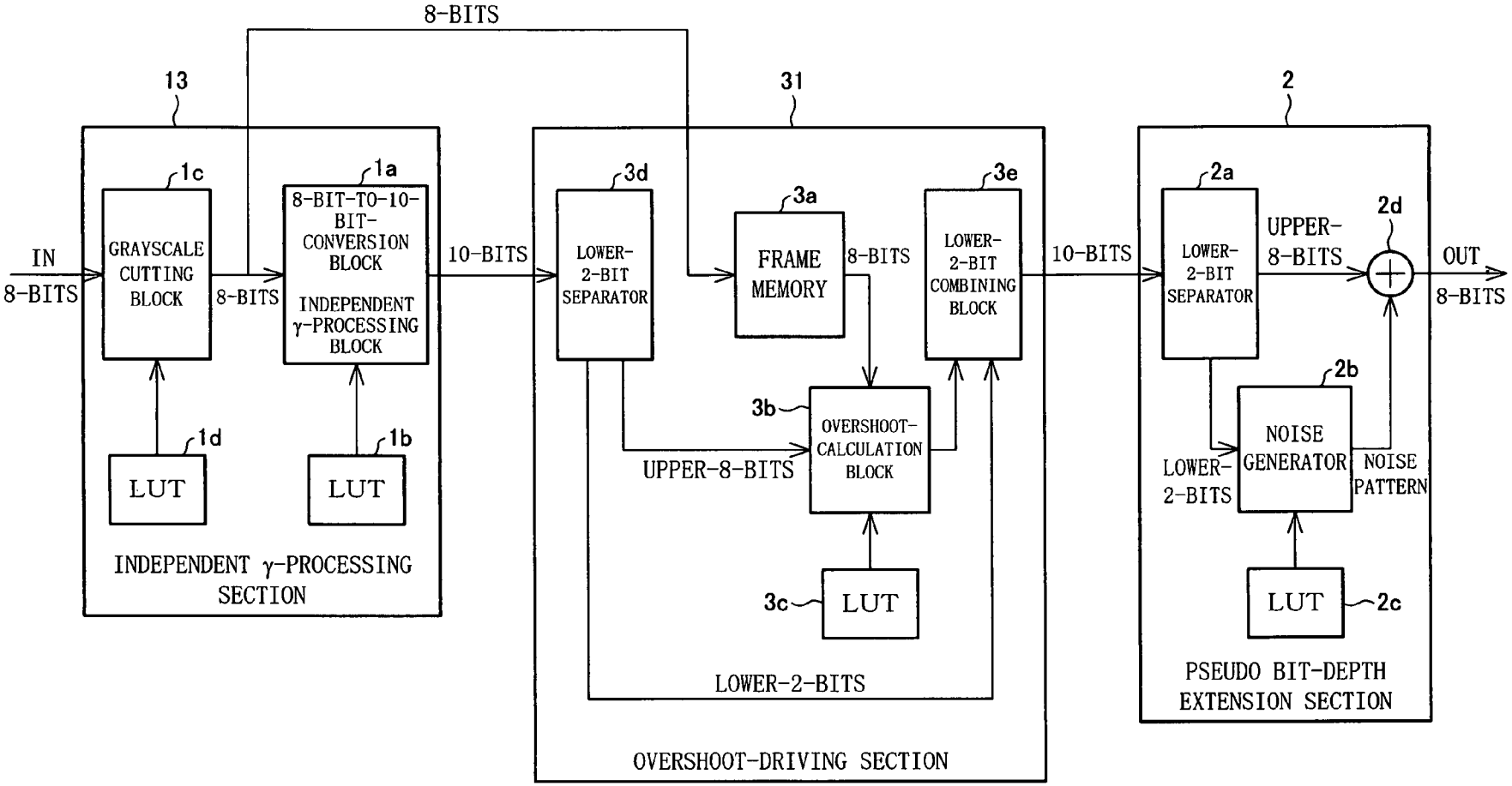
FIG. 11 is a circuit block diagram showing Embodiment 10 of the driving system in accordance with the present invention.

FIG. 11 shows a system according to Embodiment 10 of the present invention. The system includes an a grayscale cutting block 1*c*, independent γ-processing section 13, an overshoot-driving section 31, and a pseudo bit-depth extension section 2, each of which are arranged in this order. In this system, the 8-bit data from the grayscale cutting block 1*c* is stored in the frame memory 3*a*, and is used as the previous frame data for use in the overshoot-driving section 31. In Embodiment 10, the grayscale cutting block 1*c* and the independent γ-processing block 1*a* are not combined with each other, and are arranged in a reversed order of the arrangement of those in the foregoing Embodiment 1.

Accordingly, the system of Embodiment 10 is preferably applied to a driving system with a sufficient volume of memory, or a driving system using an overshoot-driving section 32 of the foregoing Embodiment 4 in which an overshoot-driving section and an independent γ-processing section are combined with each other.

Embodiment 11

Figure 12:
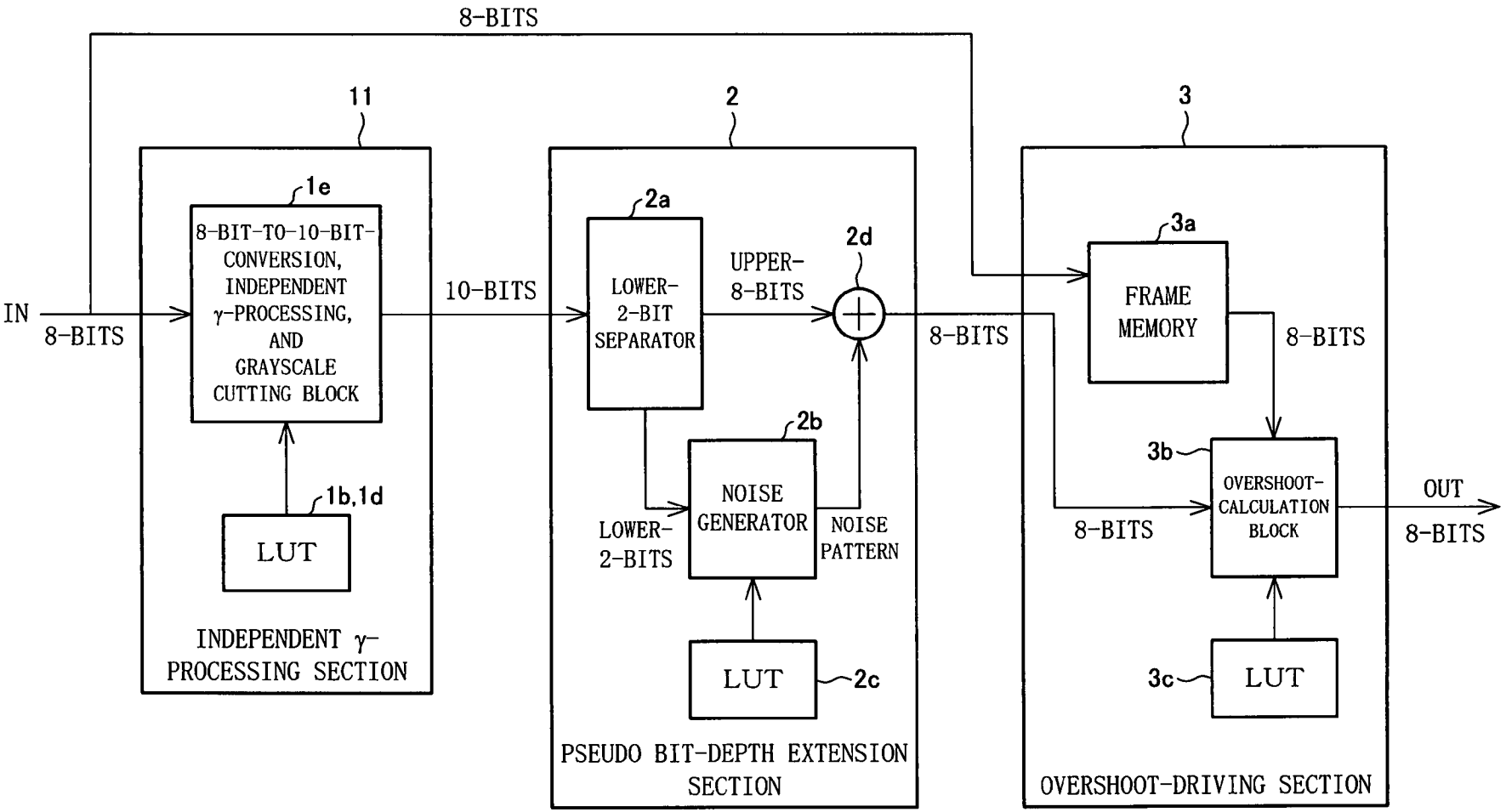
FIG. 12 is a circuit block diagram showing Embodiment 11 of the driving system in accordance with the present invention.

FIG. 12 shows a system according to Embodiment 11 of the present invention. The system includes an independent γ-processing section 11 (grayscale cutting block included), a pseudo bit-depth extension section 2, and an overshoot-driving section 3, each of which are arranged in this order. In this system, input 8-bit data for the independent γ-processing section 11 is used as the previous frame data for use in the overshoot-driving section 3, and therefore the 8-bit data is stored in the frame memory 3*a* before inputted to the independent γ-processing section 11 including a grayscale cutting function.

Embodiment 12

Figure 13:
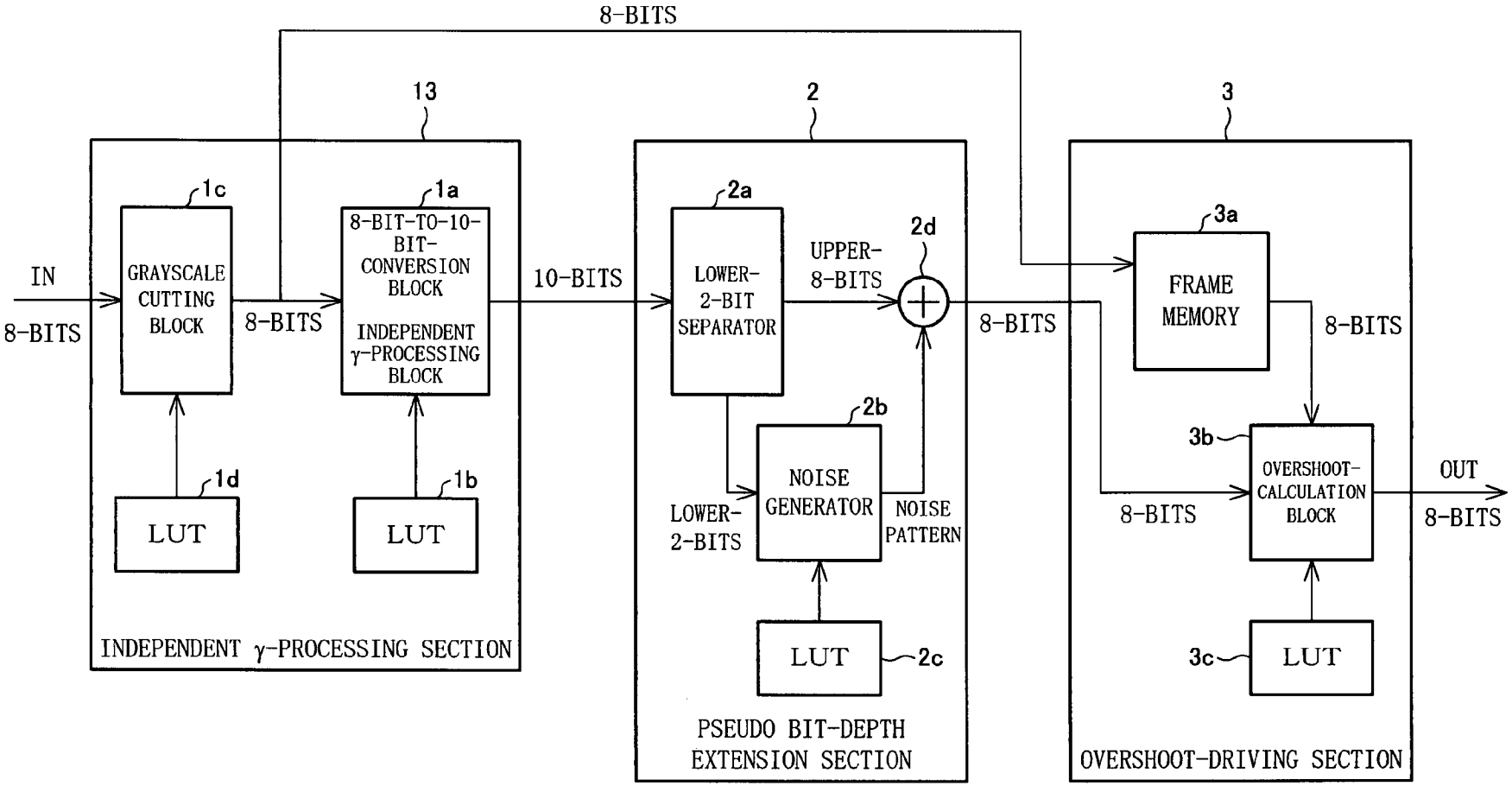
FIG. 13 is a circuit block diagram showing Embodiment 12 of the driving system in accordance with the present invention.

FIG. 13 shows a system according to Embodiment 12 of the present invention. The system includes an independent γ-processing section 13 (grayscale cutting block 1*c* included), a pseudo bit-depth extension section 2, and an overshoot-driving section 3, each of which are arranged in this order. In this system, the output of the grayscale cutting block 1*c* is used as the previous frame data for use in the overshoot-driving section 3, which output is 8-bit data stored in the frame memory 3*a*.

For each of the embodiments 5 through 12, the same evaluation as that for Embodiments 1 through 4 was performed, with a result that all of the systems of Embodiments 5 through 12 ensured high-speed response and high quality display.

As described, various effects can be obtained by the present invention.

First, the display device of the present invention uses (A) an LCD that outputs n-bit data (n is an integer not less than 8), and (B) a driving system having (i)a pseudo bit-depth extension section 2 for carrying out n-bit conversion by a pseudo bit-depth extension so as to convert m-bit data (m is an integer greater than the n) into n-bit data, and (ii) an overshoot-driving block such as the overshoot-driving section 3 or 31, wherein the amount of noise added to data is minimized, and the overshoot-driving is always performed with respect to 8-bit data. With this arrangement, regardless of relative positions of the pseudo bit-depth extension section 2 and the overshoot-driving section, a display device ensuring high quality of image reproduction and high-response-speed is realized without changing the scale of circuit, Further, the noise pattern generated in the pseudo bit-depth extension section 2 is specified based on (i) a local coordinate of a region whose size is 4×4×RGB, 8×8×RGB, or 16×16×RGB, (ii) lower-bit of the m-bit data (i.e. (m-n)-bit), (iii) a frame counter being reset every 8 frames or 16 frames. This keeps the noise pattern insignificant, thereby realizing a display device capable of a wider range of visible grayscales free from influence of noise.

Further, by providing the independent γ-processing block in a preceding stage of the pseudo bit-depth extension section 2 and the overshoot-driving block, so as to convert input data into m-bit data. This results in a smooth γ-curve, thereby realizing a display device with high reproduction quality without color fading or degradation in tones.

Further, by placing the grayscale cutting block in a preceding or a following stage of the pseudo bit-depth extension section 2, the overshoot-driving effectively improves the response speed in a transition to any of the grayscales, including the transition to black or white, which effect was not overcome by conventional devices, Thus, the response speed in transition to any of the grayscales is accelerated.

Further, an appropriate set of the grayscale cutting block, independent γ-processing block, and the overshoot-driving block, each of which requires LUT, can be combined together in consideration of their systems and the circuit scale, thereby reducing the number of LUTs. Thus, it is possible to provide, at a low cost, a display device with the high quality of the image reproduction and a high response-speed.

It should be noted that, all of the foregoing embodiments deal with a case where the driving system of the present invention is mounted to a LCD as a display device; however, the present invention can be adopted to any devices and any systems in which the pseudo bit-depth extension and the overshoot-driving are performed.

In order to solve the foregoing problem, a driving system (driving circuit) of the present invention for use in a display device includes: (I) a pseudo bit-depth extension block for increasing visible gradation levels by (i) adding a noise pattern to upper-8-bits of input m-bit data (m being an integer not less than 9), and (ii) outputting as output data upper-n-bit (n being an integer not less than 8 and less than m) of data obtained by adding the noise pattern to the upper-8 bits of the input m-bit data; (II) an overshoot-driving block for performing overshoot-driving in display operation, an amount of the noise pattern being not more than 1 in 8-bit data, and the overshoot-driving block for performing calculation on 8-bit basis.

The foregoing arrangement (I) adopts a displaying device that outputs n-bit data where n is not less than 8, (II) minimizes a noise amount (1 or less) added to data in pseudo bit-depth extension, and (III) carries out overshoot-driving process consistently with 8-bit data. With this arrangement, for both algorisms: (a) the pseudo bit-depth extension is performed before the overshoot-driving, or (b) the overshoot-driving is performed before the pseudo bit-extension; the same effect can be obtained with the same scale of circuit.

Here, the foregoing display device is limited to a display device capable of outputting data of 8 or a larger number of bits, on the grounds of the following facts. Namely, in order to achieve high quality image reproduction, it is estimated that a display device needs to output at least 8-bit data. That is, it is required that the display device needs to be capable of reproducing at least 256 grayscales (16.77 million colors). In this view, it is not reasonable or feasible in the first place to realize high quality of the image reproduction with a display device that fails to meet this requirement.

Further, in terms of costs for a driver, it is not currently preferable to adopt the present invention to a display device capable of reproducing higher number of grayscales. However, such a cost problem is expected to be solved in the future. Thus it is the most effective to adopt the present invention to a display device that outputs not less than 8-bit data.

Further, in order to avoid mistakenly amplifying noise incidental to the original image signal due to some reason, when an amount of transition in grayscale is not more than a predetermined amount, the overshoot-driving process is not carried out, the predetermined amount being a through-grayscale width.

A specific value of the through-grayscale width varies depending on a purpose for which the displaying device is designed. For example, in a case of display device designed for HDTV, the through-grayscale width is set to approximately 3 of 256 grayscales. Accordingly, if noise in an amount of 1 or less of the 256 grayscales of the 8-bit data (i.e. 1 grayscale or less) is generated in the pseudo bit-depth extension process, it does not affect the overshoot-driving. Therefore, it is possible to adopt the present invention to an algorithm which carries out the overshoot-driving after the pseudo bit-depth extension.

Further, although it is idealistic to carry out the overshoot-driving with the same bit number as that of the input data in a case of inputting n-bit data to the overshoot-driving section, the inventors of the present invention have found that, overshoot driving using 8-bit data provides sufficient effect.

More specifically, the calculation in overshoot-driving can be carried out with upper-8-bits of the input n-bit data, allowing the lower-(n-8)-bit pass through the overshoot-driving section without being processed. This lower-(n-8)-bit is later added to the 8-bit data resulted from the calculation. In this way, it is not necessary to carry out the calculation of overshoot-driving with the n-bit, the cost rise for circuit is prevented.

Further, although the low-(n-8)-bit is not subjected to the overshoot-driving process, sufficient effects can be obtained by carrying out the calculation of the overshoot-driving process based on 8-bits. Thus, an influence of the unprocessed low-(n-8)-bit to the displayed image is ignorable. This algorithm realizes a display device with a high-response speed and high quality in image reproduction, without a significant increase in cost.

Further, in the case where m-bit data is inputted to the overshoot-driving section, the calculation of overshoot-driving is carried out using upper-8-bits of the inputted m-bit data, and the lower-(m-8)-bit passes through the overshoot-driving section without being processed, and is added to 8-bit data resulted from the calculation. Since it is not necessary to carry out the calculation of overshoot-driving based on the entire m-bit, an increase in cost of the circuit is prevented.

Although the lower-(m-8)-bit is not subjected to the overshoot-driving, sufficient effects can be obtained by carrying out the calculation of overshoot-driving based on 8-bits. Thus, an influence of the unprocessed lower-(n-8)-bit to the displayed image is ignorable. This algorithm which carries out the pseudo bit-depth extension after the overshoot-driving process is carried out realizes a display device with a high-response speed and high quality in image reproduction, without a significant increase in cost.

Further, the addition of noise amount of 1 (in terms of 256 gradation levels) or less (more preferably less than 1), can be performed according to, for example, a method disclosed in Japanese Patent Application No. 2003-175251 (Tokugan 2003-175251). More specifically, the noise pattern may be determined as follows. Namely, the display screen is divided into appropriate-sized plural blocks, and then among those blocks, it is decided whether or not to add 1 as noise to the least significant-bit of the upper-8-bit of the inputted m-bit data, in accordance with the lower-(m-n)-bit of the m-bit data and a value of the frame counter.

Since the size of a block of the display screen is determined based on a circuit, it is preferable to set the size of the block in a unit of $2^j$ pixels (where j is an integer). Here, if the size of the block is too small, it will make the effects of the pseudo bit-depth extension insufficient; on the other hand, if the size of the block is too large, it will cause an increase in circuit scale, thus causing an increase in cost. It was confirmed that the present invention is sufficiently effective with a block whose size is 4×4×RGB, 8×8×RGB, or 16×16×RGB. Accordingly, the value of J is preferably 2, 3, or 4.

Further, the frame counter is also determined according to the circuit. Therefore, it is preferable to provide $2^l$ frames (where l is an integer). If the number of frame counter is too small, it will also make the effect of pseudo bit-depth extension insufficient; on the other hand, if a time period of the frame counter is too large, it will cause an increase in circuit scale, thus causing an increase in cost. It was confirmed that the present invention is most effective when the frame counter is reset at a cycle of every 8 frames or 16 frames.

Further, the driving system of the present invention may further include an independent γ-processing block provided in a preceding stage of the pseudo bit-depth extension block and an overshoot-driving block, for respectively converting R, G and B signals (input data) into m-bit data.

An independent γ-process is an effective method for correcting colors. However, in the case of display device whose input/output data is in 8-bits, the independent γ-process results in an irregular γ-curve due to degradation in tone or fading of gradation. However, with an independent γ-processing block having a function of extending input data to m-bit data, such degradation in tone or fading of gradation is prevented, thus obtaining a smooth γ-curve.

The bit-depth of input signal varies depending on the source signal of image, but the input signal is usually 6-bits or more. In the case where the input signal is m or a larger-bits, information in the lower-bit of the input signal is cut-off, and therefore, there is no effect in performing bit-depth extension, thus the subject matter of the present invention cannot be realized.

Further, the driving system of the present invention may further include a grayscale cutting block in a preceding/following stage of the independent γ-processing block, for cutting off a part of grayscales of an input grayscale signal, or for compressing the converted input signal to a signal including a region not containing the grayscales.

In a general overshoot-driving, an overshooting parameter is determined within a range of the 0th to 255th grayscales, though grayscales represented by a signal are also ranged from the 0th to 255th grayscales. Therefore, the overshoot-driving does not affect transition in the vicinity of the 0th grayscale and transition in the vicinity of the 255th grayscale. By providing the grayscale cutting block, the range of grayscale represented by the input signal is reduced to a range of, for example, the 8th to 248th grayscales, while the overshooting parameter is determined within the range of the 0th to 255th grayscales. Therefore, the overshoot-driving becomes effective in transition between any of the grayscales. It should be noted that the grayscale cutting block may be omitted in the case where response speed of, for example, liquid crystal is sufficiently high, and the response speed in transition in the vicinity of the 0th grayscale or in the vicinity of the 255th grayscale is sufficiently high.

Further, it is more effective to use the grayscale cutting block with the independent γ-processing block. In particular, by adjacently arranging the grayscale cutting block and the independent γ-processing block, it is possible to combine grayscale conversion rules of the grayscale cutting block with grayscale conversion rules of the independent γ-processing block as a single LUT. This reduces a required amount of memory, thus preventing an increase in circuit scale.

Further, the driving system of the present invention having the overshoot-driving block, pseudo bit-depth extension block, independent γ-processing block, and the grayscale cutting block may further include a look-up-table containing a combination of a conversion rule applied in the independent γ-processing block and a conversion rule applied in the grayscale cutting block.

The overshoot-driving block, pseudo bit-depth extension block, and the independent γ-processing block each requires an LUT for storing conversion rules, and a memory for storing the LUT. Therefore, an enormous volume of memory is required for each block. This defect may be avoided by combining the LUTs; however, the LUT for the pseudo bit-depth extension block stores noise generation patterns, and differs from the other LUTs.

For this reason, the LUT for the overshoot-driving block and the LUT for the independent γ-processing block are combined as an unified LUT, thereby saving (i) the memory, preventing (ii) increases in circuit scale and cost. However, the LUTs can only be combined in the case where the overshoot-driving block is positioned in a preceding stage of the pseudo bit-depth extension block. When these blocks are arranged in the reverse order, there is a difficulty in combining their LUTs.

Therefore, the driving system of the present invention having the overshoot-driving block, pseudo bit-depth extension block, independent γ-processing block, and the grayscale cutting block may further include (I) a look-up-table specifying conversion data for use in the independent γ-processing block; and (II) a look-up-table specifying an overshooting parameter of the overshoot-driving block.

This arrangement is effective to the case where the overshoot-driving block is positioned in a following stage of the pseudo bit-depth extension block. However, if a sufficient memory is available, the foregoing arrangement is also effective when the overshoot-driving block is positioned in preceding a stage of the pseudo bit-depth extension block.

The driving system of the present invention may be adapted so that the overshoot-driving block outputs 8-bit data resulted from overshoot-driving that is performed by using a current frame data and a previous frame data, the current frame data being 8-bit data processed in the pseudo bit-depth extension block, and the previous frame data being data which has been stored in a frame memory.

Further, the driving system of the present invention may be adapted so that the overshoot-driving block outputs 8-bit data resulted from overshoot-driving that is performed by using a current frame data and a previous frame data, the current frame data being 8-bit data processed by (a) the grayscale cutting block, the independent γ-processing block, and the pseudo bit-depth extension block in this order, or by (b) the independent γ-processing block, the grayscale cutting block, and the pseudo bit-depth extension block in this order, and the previous frame data being data which has been stored in a frame memory.

The following describes specific details of the driving system in accordance with the present invention, for use in a displaying device. In a driving system (driving method) of the present invention, (I) input data for producing grayscales is k-bit data, where k is an integer and $6 \leqq k < m$ (where m is an integer not less than 9); (II) when $k \leqq 7$, 0 is added to lower-(8-K) bit of the input k-bit data, and data obtained by adding 0 is stored in a frame memory; (III) when $k \geqq 8$, upper-8-bits of the k-bit data is stored in the frame memory; (IV) the input k-bit-data is converted into m-bit-data in an independent γ-processing block; (V) overshoot-driving is carried out based on current frame data and previous frame data wherein the current frame data is upper-8-bit data of the m-bit-data, and the previous frame data is data stored in the frame memory; (VI) lower-(m-8) bit data of the current frame data is added to data resulted from the overshoot-driving so that m-bit overshoot-driving data is created; and (VII) the m-bit overshoot-driving data is processed in a pseudo bit-depth extension block, and is outputted in the form of 8-bit data.

Further, in a driving system of the present invention, (I) input data for producing grayscales is k-bit data, where k is an integer and $6 \leqq k < m$ (where m is an integer not less than 9); (II) when $k \leqq 7$, 0 is added to lower-(8-K) bit of the input k-bit data, and data obtained by adding 0 is stored in a frame memory; (III) when $k \geqq 8$, upper-8-bits of the k-bit data is stored in the frame memory; (IV) the input k-bit-data is converted into 8-bit data by an independent γ-processing block and pseudo bit-depth extension block in this order; (V) overshoot-driving is carried out based on current frame data and previous frame data wherein the current frame data is the 8-bit-data obtained through the independent γ-processing block and the pseudo bit-depth extension block, and the previous frame data is data stored in the frame memory; (VI) data resulted from the overshoot driving is outputted in the form of 8-bit data.

Further, in a driving system of the present invention, (I) input data for producing grayscales is k-bit data, where k is an integer and $6 \leqq k < m$ (where m is an integer not less than 9); (II) when $k \leqq 7$, 0 is added to lower-(8-K) bit of the input k-bit data, and data obtained by adding 0 is stored in a frame memory; (III) when $k \geqq 8$, upper-8-bits of the k-bit data is stored in the frame memory; (IV) the input k-bit-data is converted into m-bit data by (i) a grayscale cutting block and an independent γ-processing block in this order, or (ii) an independent γ-processing block and a grayscale cutting block in this order; (V) overshoot-driving is carried out based on current frame data and previous frame data wherein the current frame data is upper-8-bit-data of the m-bit data, and the previous frame data is data stored in the frame memory; (VI) lower-(m-8) bit data of the current frame data is added to data resulted from the overshoot-driving so that m-bit overshoot-driving data is created; and (V) the m-bit data obtained by adding the lower-(m-8) bit data is added is processed in a pseudo bit-depth extension block, and is outputted in the form of 8-bit data.

Further, in a driving system of the present invention, (I) input data for producing grayscales is k-bit data, where k is an integer and $6 \leqq k < m$ (where m is an integer not less than 9); (II) when $k \leqq 7$, 0 is added to lower-(8-K) bit of the input k-bit data, and data obtained by adding 0 is stored in a frame memory; (III) when $k \geqq 8$, upper-8-bits of the k-bit data is stored in the frame memory; (IV) the input k-bit-data is converted into m-bit-data in an independent γ-processing block; (V) overshoot-driving is carried out based on current frame data and previous frame data wherein the current frame data is upper-8-bit data of the m-bit, and the previous frame data is data stored in the frame memory; (VI) lower-(m-8) bit data of the current frame data is added to data resulted from the overshoot-driving so that m-bit is created; and (VII) the m-bit data to which the lower-(m-8) bit data is added is processed in a pseudo bit-depth extension block, and is outputted in the form of 8-bit data.

Further, in a driving system of the present invention, (I) input data for producing grayscales is k-bit data, where k is an integer and $6 \leqq k < m$ (where m is an integer not less than 9); (II) when $k \leqq 7$, 0 is added to lower-(8-K) bit of the input k-bit data, and data obtained by adding 0 is stored in a frame memory; (III) when $k \geqq 8$, upper-8-bits of the k-bit data is stored in the frame memory; (IV) the input k-bit data is converted into 8-bit data by (i) a grayscale cutting block, an independent γ-processing block and a pseudo bit-depth extension block in this order, or (ii) the independent γ-processing block, the grayscale cutting block, and the pseudo bit-depth extension block in this order; (V) overshoot-driving is carried out based on current frame data and previous frame data wherein the current frame data is the 8-bit-data converted from the input k-bit data, and the previous frame data is data stored in the frame memory; (VI) data resulted from the overshoot driving is outputted in the form of 8-bit data.

Further, in a driving system of the present invention, (I) input data for producing grayscales is k-bit data, where k is an integer and 6≦k<m (where m is an integer not less than 9); (II) when k≦7, 0 is added to lower-(8-K) bit of the input k-bit data, and data obtained by adding 0 is stored in a frame memory; (III) when k≧8, upper-8-bits of the k-bit data is stored in the frame memory; (IV) overshoot-driving is carried out based on current frame data and previous frame data wherein the current frame data is the 8-bit-data obtained through the independent γ-processing block and the pseudo bit-depth extension block, and the previous frame data is data stored in the frame memory; (V) data resulted from the overshoot driving is outputted in the form of 8-bit data.

Further, the foregoing eight driving systems may be adapted so that a part of look-up-tables for use in processes by the blocks, sequentially arranged without interposing a memory, is used as a common look up table for all of the blocks, so that the blocks form one conversion block. Particularly, by using the unified look-up-table particularly to the conversion block in which each of the blocks are sequentially arranged without interposing a frame memory, the number of LUTs is reduced.

Here, a default γ-value of luminance property of the displaying device to which the present invention is adopted is not less than an output γ-value whose value is estimated based on an input signal. In general, in a video signal including input data, it is assumed that the default γ-value for display of a display device is set to 2.2.

Accordingly, if the default γ-value of the display device used for the present invention is less than 2.2, it is impossible to achieve desired quality in image reproduction. On the contrary, by adopting the present invention to a display device whose γ-value is 2.2, grayscales are re-allotted with respect to signal having been processed in the independent γ-processing block and the grayscale cutting block on condition γ=2.2. Since the grayscales are re-allotted to 9 or larger bits data, overall grayscales are reproduced smoothly without degradation in tone or fading of gradation.

Further, since the upper and the lower ranges of voltage, that were supposed to be used for reproducing the lost grayscales, that have been cut off by the grayscale cutting block, can be used for overshoot-driving, it is possible to realize a display capable of effectively carrying out overshoot-driving. Accordingly, the present invention realizes a display device in which γ-value of 2.2 is more accurately reflected, and response speed is accelerated.

However, when the black-sided grayscales are cut off, the luminance of black increases, thereby causing an decreasing in contrast. In order to solve this problem, the black-sided grayscales are intentionally degraded by setting the γ-value higher than 2.2, so as to overcome the brightness of black-sided grayscales. Thus, it is preferable to set the γ-value of the displaying device to a large value. Further, increasing the bit-number of input signal causes significant improvement particularly in reproduction of black-sided grayscales.

Accordingly, it is preferable to setting the γ-value of the display device to a large value, so as to improve the effect of superior reproduction. Further, in the grayscale cutting block, a signal representing the black-sided grayscales is also partially cut off, and therefore, it is an indispensable objective to improve reproduction of black-sided grayscales expressed by the cut off signal Therefore, it is required to set the γ-value to a large value in the display device. However, if the γ-value is excessively large, the degradation of black-sided grayscales becomes too significant. Thus, γ-value is preferably set around 2.5 to 3.0.

Further, the independent γ-processing block is capable of changing the γ-value through digital processing. By cutting a part of black-sided grayscales and/or white-based grayscales by the grayscale cutting block, the display device automatically has a smaller γ-value in the gradation display region than the default value. Accordingly, in the independent γ-processing block, γ-characteristic of the displayed grayscales are set higher than the default γ-value, so that the default γ-value for the gradation display region is maintained. Thus, the γ-characteristic for grayscales outside the gradation display region automatically becomes smaller than the γ-characteristic of the grayscales inside the gradation display region.

Effects of the Invention

A driving system of the present invention includes: (I) a pseudo bit-depth extension block for increasing visible gradation levels by (i) adding a noise pattern to upper-8-bits of input m-bit data (m being an integer not less than 9), and (ii) outputting as output data upper-n-bit (n being an integer not less than 8 and less than m) of data obtained by adding the noise pattern to the upper-8 bits of the input m-bit data; (II) an overshoot-driving block for performing overshoot-driving in display operation, an amount of the noise pattern being not more than 1 in 8-bit data, and the overshoot-driving block for performing calculation on 8-bit basis.

The foregoing arrangement (I) adopts a displaying device that outputs n-bit data where n is not less than 8, (II) minimizes a noise amount (1 or less) added to data in pseudo bit-depth extension, and (III) carries out overshoot-driving process consistently with 8-bit data. With this arrangement, for both algorisms: (a) the pseudo bit-depth extension is performed before the overshoot-driving, or (b) the overshoot-driving is performed before the pseudo bit-extension; the same effect can be obtained with the same scale of circuit.

Thus, the foregoing arrangement realizes high-quality image reproduction that is achieved by the overshoot-driving and the high-speed response obtained by the pseudo bit-depth extension. At the same time, the arrangement further achieves reduction in bit-number of data for use in the overshoot-driving. Thus the arrangement prevents an increase in the cost by an increase in memory amount and a number of calculation processes, due to an increase in bit-number of data.

INDUSTRIAL APPLICABILITY

A driving system of the present invention for use in a display device achieves (a) improvement in image reproduction quality by carrying out pseudo bit-depth extension and overshoot-driving, and (b) reduction in bit-number of data used for the overshoot-driving process. In this way, an increase in bit-number of data is prevented, thereby preventing an increase in cost for overshoot-driving. This driving system is suitably adopted to a field of image reproduction such as HDTV (high-definition television) that requires high quality image reproduction.

The following explains differences between the present invention and related prior arts, according to the inventors of the present invention.

In a liquid crystal control circuit disclosed in Japanese Patent No. 2708746, gradation data is written to a frame memory that stores a frame of gradation data. Then, when the written gradation data is larger than the stored data according to the input gradation data, correction data for enabling reproduction of target gradations of a following frame is outputted. If the data is not larger than the stored data, the input grayscale data is outputted as such.

The foregoing Japanese Patent No. 2708746, however, deals with only the overshoot-driving and does not mention the pseudo bit-depth extension, which is one of features of the present invention.

Japanese Patent No. 2650479 discloses a liquid crystal control circuit in which output data is acquired by calculation using a previous frame and the currently displayed frame, and the output values are continuously corrected in this way also for the later frames. Unlike this Japanese Patent No. 2650479, in the present invention, once correction is made for one frame, the correction result will not be subjected to another correction in the later frames. Further, in the present invention, it is not necessary to successively carry out correction in gradation. This is because the present invention realizes more effective high-speed driving by combining the overshoot-driving and the pseudo bit-depth extension.

Japanese Unexamined Patent Publication No. 2001-337667 (Tokukai 2001-337667) discloses an image processing device including (I) a first signal processing circuit for converting an input digital signal, that is a n-bit image signal (n is an integer), into a m-bit digital signal (m is an integer and m>n), and (II) a second signal processing circuit for adding noise to the signal so as to reduce a pseudo contour caused by the conversion of the signal, and outputting a digital signal, obtained by cutting off the lower-bit from the signal, to a display section.

Unlike the foregoing Tokukai 2001-337667, in the present invention in which the overshoot-driving and the pseudo bit-depth extension are combined, the noise amount of the noise pattern used for the pseudo bit-depth extension is set to a small value (1 or less in 8-bit data). Therefore, it is not necessary to specify relative positions of the overshoot-driving block and the pseudo-bit-depth extension block. In contrast, Tokukai 2001-337667 does not at all mention a specific noise amount. Further, in the arrangement of this publication, it is required that the pseudo bit-depth extension block is provided in a following stage of the overshoot-driving block.

Lastly, Japanese Unexamined Patent Publication No. 2002-116743 (Tokukai 2002-116743) discloses still another driving method for a liquid crystal display device. In this method, plural frame memories are provided for respectively storing input signals for three frames, and forepast image data is read out twice at a double-speed, while image data is being written to one of the frame memory. Then, if the input image data is greater than the forepast image data, the liquid crystal display device is supplied with image data having a data value larger than a target data value, and this image data is supplied twice in a frame period.

Unlike the foregoing Tokukai 2002-116743, the present invention uses a region generated by the pseudo bit-depth extension, which region is not used for displaying upper and/or lower grayscales. In this way, the present invention achieves effective overshoot-driving with a different arrangement from that of the foregoing publication.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A driving system, for use in a displaying device capable of gradation display, comprising:

a pseudo bit-depth extension block configured to increase visible gradation levels by (i) adding a noise pattern to upper-8-bits of input m-bit data (m being an integer not less than 9), and (ii) outputting as output data upper-n-bit (n being an integer not less than 8 and less than m) of data obtained by adding the noise pattern to the upper-8 bits of the input m-bit data;

an overshoot-driving block configured to perform overshoot-driving in display operation, an amount of the noise pattern being set to be an amount causing a change of 1 grayscale level or less among levels of grayscale of 8-bit data, and the overshoot-driving block being configured to perform calculation on 8-bit basis.

2. The driving system as set forth in claim 1, wherein:

the pseudo bit-depth extension block is positioned in a preceding stage of the overshoot-driving block; and the overshoot-driving block is configured to perform the calculation using upper-8-bit of input n-bit data of the overshoot-driving block.

3. The driving system as set forth in claim 1, wherein:

the pseudo bit-depth extension block is positioned in a following stage of the overshoot-driving block; and the overshoot-driving block carries out the calculation using upper-8-bit of input m-bit data of the overshoot-driving block.

4. The driving system as set forth in claim 1, further comprising:

an independent γ-processing block provided in a preceding stage of the pseudo bit-depth extension block, for respectively converting R, G and B signals into m-bit data.

5. The driving system as set forth in claim 4, wherein:

the independent γ-processing block is supplied with a signal ranging from 6-bits to m-bits.

6. The driving system as set forth in claim 4, further comprising:

a grayscale cutting block provided in a preceding stage of the independent γ-processing block, for cutting off a part of grayscales of an input grayscale signal, or for compressing the grayscales to a region where a part of the grayscales is excluded.

7. The driving system as set forth in claim 6, further comprising:

a look-up-table containing a combination of a conversion rule applied in the independent γ-processing block and a conversion rule applied in the grayscale cutting block.

8. The driving system as set forth in claim 6, wherein:

the overshoot-driving block outputs 8-bit data resulted from overshoot-driving that is performed by using a current frame data and a previous frame, the current frame data being 8-bit data processed by the grayscale cutting block, the independent γ-processing block, and the pseudo bit-depth extension block in this order, and the previous frame data being data which has been stored in a frame memory.

9. The driving system as set forth in claim 6, wherein:

a γ-value is set high for grayscales between a highest grayscale and a grayscale corresponding to a maximum output of the grayscale cutting block; and a γ-value is set relatively low for other grayscales.

10. The driving system as set forth in claim 4, further comprising:

a grayscale cutting block provided in a following stage of the independent γ-processing block, configured to cutting or compressing at least one of upper and/or lower grayscales represented by a grayscale signal.

11. The driving system as set forth in claim 10, further comprising:

a look-up-table containing a combination of a conversion rule applied in the independent γ-processing block and conversion rule applied in the grayscale cutting block.

12. The driving system as set forth in claim 10, wherein:

the overshoot-driving block is configured to output 8-bit data resulted from overshoot-driving that is performed by using a current frame data and a previous frame, the current frame data being 8-bit data processed by the independent γ-processing block, the grayscale cutting block, and the pseudo bit-depth extension block in this order, and the previous frame data being data which has been stored in a frame memory.

13. The driving system as set forth in claim 10, wherein:

a γ-value is set high for grayscales between a highest grayscale and a grayscale corresponding to a maximum output of the grayscale cutting block; and a γ-value is set relatively low for other grayscales.

14. The driving system as set forth in claim 4, further comprising:

a look-up-table containing a conversion rule determined according to (i) conversion data used in the independent γ-processing block and (ii) an overshooting parameter of the overshoot-driving block.

15. The driving system as set forth in claim 4, further comprising:

a look-up-table specifying conversion data for use in the independent γ-processing block; and a look-up-table specifying an overshooting parameter of the overshoot-driving block.

16. The driving system as set forth in claim 1, further comprising:

an independent γ-processing block provided in a preceding stage of the overshoot-driving block, for respectively converting R, G and B signals into m-bit data.

17. The driving system as set forth in claim 16, wherein:

the independent γ-processing block is supplied with a signal ranging from 6-bits to m-bits.

18. The driving system as set forth in claim 1, wherein the noise pattern is defined by a local coordination of a region whose sized is 4×4×RGB, 8×8×RGB, or 16×16×RGB.

19. The driving system as set forth in claim 1, wherein the noise pattern is defined by information contained in lower (m-n)-bit data of the m-bit data, and a frame counter.

20. The driving system as set forth in claim 1, wherein a block of the noise pattern has a time period of 8 frames or 16 frames.

21. The driving system as set forth in claim 1, wherein:

the overshoot-driving block is configured to output 8-bit data resulted from overshoot-driving that is performed by using a current frame data and a previous frame, the current frame data being 8-bit data processed in the pseudo bit-depth extension block, and the previous frame being data which has been stored in a frame memory.

22. The driving system as set forth in claim 1, wherein:

a default γ-value of luminance property of the displaying device is not less than an output γ-value whose value is estimated based on an input signal.

23. The driving system as set forth in claim 22 wherein the output γ-value is between 2.5 and 3.0.

24. The driving system of claim 1, wherein the pseudo bit-depth extension block is configured to generate the noise pattern having a noise amount of 1 or less based on a lower-2 bits of the input data.

25. A driving system for use in a displaying device capable of gradation display with respect to each of pixels, wherein:

data for producing grayscales is k-bit data is input, where k is an integer and $6 \leqq k < m$ (where m is an integer not less than 9);

when $k \leqq 7$, 0 is added to lower-(8-K) bit of the input k-bit data, and data obtained by adding 0 is stored in a frame memory;

when $k \geqq 8$, upper-8-bits of the k-bit data is stored in the frame memory;

the input k-bit-data is converted into 8-bit data by an independent γ-processing block and a pseudo bit-depth extension block in this order;

overshoot-driving is carried out based on current frame data and previous frame data wherein the current frame data is the 8-bit-data obtained through the independent γ-processing block and the pseudo bit-depth extension block, and the previous frame data is data stored in the frame memory; and data resulted from the overshoot driving is outputted in the form of 8-bit data, wherein in the pseudo bit-depth extension block, an amount of a noise pattern added to the 8-bit data during pseudo bit-depth extension is set to be an amount causing a change of 1 grayscale level or less among levels of grayscale of 8-bit data.

26. The driving system as set forth in claim 25, wherein:

a part of look-up-tables for use in processes by the blocks, sequentially arranged without interposing a memory, is used as a common look up table for all of the blocks, so that the blocks form one conversion block.

27. The driving system as set forth in claim 25, wherein:

a part of look-up-tables for use in processes by the blocks, sequentially arranged without interposing a memory, is used as a common look up table for all of the blocks, so that the blocks form one conversion block.

28. The driving system of claim 25, wherein the pseudo bit-depth extension block is configured to generate the noise pattern having a noise amount of 1 or less based on a lower-2 bits of the input data.

29. A driving system for use in a displaying device capable of gradation display with respect to each of pixels, wherein:

data for producing grayscales is k-bit data is input, where k is an integer and $6 \leqq k < m$ (where m is an integer not less than 9);

when $k \leqq 7$, 0 is added to lower-(8-K) bit of the input k-bit data, and data obtained by adding 0 is stored in a frame memory;

when $k \geqq 8$, upper-8-bits of the k-bit data is stored in the frame memory;

the input k-bit data is converted into 8-bit data by (i) a grayscale cutting block, an independent γ-processing block and a pseudo bit-depth extension block in this order, or (ii) the independent γ-processing block, the grayscale cutting block, and the pseudo bit-depth extension block in this order;

overshoot-driving is carried out based on current frame data and previous frame data wherein the current frame data is the 8-bit-data converted from the input k-bit data, and the previous frame data is data stored in the frame memory; and data resulted from the overshoot driving is outputted in the form of 8-bit data;

wherein in the pseudo bit-depth extension block, an amount of a noise pattern added to the 8-bit data during pseudo bit-depth extension is set to be an amount causing a change of 1 grayscale level or less among levels of grayscale of 8-bit data.

30. The driving system as set forth in claim 29, wherein:

a part of look-up-tables for use in processes by the blocks, sequentially arranged without interposing a memory, is used as a common look up table for all of the blocks, so that the blocks form one conversion block.

31. The driving system as set forth in claim 29, wherein:

a part of look-up-tables for use in processes by the blocks, sequentially arranged without interposing a memory, is used as a common look up table for all of the blocks, so that the blocks form one conversion block.

32. The driving system of claim 29, wherein the pseudo bit-depth extension block is configured to generate the noise pattern having a noise amount of 1 or less based on a lower-2 bits of the input data.

33. A driving system for use in a displaying device capable of gradation display with respect to each of pixels, wherein:

data for producing grayscales is k-bit data is input, where k is an integer and $6 \leqq k < m$ (where m is an integer not less than 9);

when $\leqq k7$, 0 is added to lower-(8-K) bit of the input k-bit data, and data obtained by adding 0 is stored in a frame memory;

when $k \geqq 8$, upper-8-bits of the k-bit data is stored in the frame memory; overshoot-driving is carried out based on current frame data and previous frame data wherein the current frame data is the 8-bit-data obtained through an independent γ-processing block and a pseudo bit-depth extension block, and the previous frame data is data stored in the frame memory; and data resulted from the overshoot driving is outputted in the form of 8-bit data, wherein in the pseudo bit-depth extension block, an amount of a noise pattern added to the 8-bit data during pseudo bit-depth extension is set to be an amount causing a change of 1 grayscale level or less among levels of grayscale of 8-bit data.

34. The driving system as set forth in claim 33, wherein:

a part of look-up-tables for use in processes by the blocks, sequentially arranged without interposing a memory, is used as a common look up table for all of the blocks, so that the blocks form one conversion block.

35. The driving system as set forth in claim 33, wherein:

a part of look-up-tables for use in processes by the blocks, sequentially arranged without interposing a memory, is used as a common look up table for all of the blocks, so that the blocks form one conversion block.

36. The driving system of claim 33, wherein the pseudo bit-depth extension block is configured to generate the noise pattern having a noise amount of 1 or less based on a lower-2 bits of the input data.

* * * * *